US009994986B2

(12) United States Patent
Kim et al.

(10) Patent No.: US 9,994,986 B2
(45) Date of Patent: Jun. 12, 2018

(54) WASHING MACHINE AND METHOD FOR CONTROLLING THE SAME

(71) Applicant: Samsung Electronics Co., Ltd., Suwon-si (KR)

(72) Inventors: Seung Oh Kim, Suwon-si (KR); Young Myung Son, Hwaseong-si (KR); Ji Hoon Choi, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 110 days.

(21) Appl. No.: 14/795,003

(22) Filed: Jul. 9, 2015

(65) Prior Publication Data

US 2016/0010257 A1 Jan. 14, 2016

(30) Foreign Application Priority Data

Jul. 11, 2014 (KR) ..... 10-2014-0087550
Sep. 19, 2014 (KR) ..... 10-2014-0124970

(51) Int. Cl.
*D06F 17/06* (2006.01)
*D06F 37/40* (2006.01)
(Continued)

(52) U.S. Cl.
CPC ..... *D06F 17/06* (2013.01); *D06F 37/40* (2013.01); *D06F 39/083* (2013.01); *D06F 17/10* (2013.01);
(Continued)

(58) Field of Classification Search
CPC ..... D06F 37/40; D06F 17/06; D06F 33/02; D06F 39/083; D06F 39/087;
(Continued)

(56) References Cited

U.S. PATENT DOCUMENTS 5,586,455 A * 12/1996 Imai ..... D06F 37/40 68/12.02
5,651,277 A * 7/1997 Richardson ..... D06F 37/40 68/133
(Continued)

FOREIGN PATENT DOCUMENTS

CN 1218122 6/1999
CN 201538893 8/2010
(Continued)

OTHER PUBLICATIONS

Chinese Office Action dated Nov. 30, 2016 in Chinese Patent Application No. 201510683466.0.
(Continued)

*Primary Examiner* — Joseph L. Perrin
(74) *Attorney, Agent, or Firm* — Staas & Halsey LLP

(57) ABSTRACT

A washing machine includes: a tub configured to accommodate wash water therein; a rotary tub rotatably mounted in the tub; a pulsator rotatably arranged below the rotary tub, configured to form a water current; a motor configured to provide driving power to the pulsator; and a floater configured to ascend or descend in response to a water level of the wash water in such a manner that the pulsator and the rotary tub interact with each other or the interaction therebetween is released. The pulsator includes a reinforcement rib protruding from a bottom surface of the pulsator to reinforce stiffness. The floater is connected to the reinforcement rib in a manner that the floater ascends or descends along the reinforcement rib. The washing machine can alternatively transmit the driving power of the motor only to the pulsator or to the pulsator and the rotary tub.

32 Claims, 25 Drawing Sheets

(51) Int. Cl.

| | |
|---|---|
| ***D06F 39/08*** | (2006.01) |
| ***D06F 33/02*** | (2006.01) |
| *D06F 37/14* | (2006.01) |
| *D06F 17/10* | (2006.01) |

(52) U.S. Cl.
CPC ..... *D06F 33/02* (2013.01); *D06F 37/14* (2013.01); *D06F 39/087* (2013.01); *D06F 2202/085* (2013.01); *D06F 2202/12* (2013.01); *D06F 2204/06* (2013.01); *D06F 2204/084* (2013.01)

(58) Field of Classification Search
CPC ..... D06F 2202/12; D06F 2202/085; D06F 2204/06; D06F 2204/084
See application file for complete search history.

(56) References Cited

U.S. PATENT DOCUMENTS

| | | | | |
|---|---|---|---|---|
| 6,634,193 | B2 * | 10/2003 | Lee | D06F 37/40 68/23.6 |
| 6,880,192 | B2 * | 4/2005 | Lee | D06F 37/40 68/23.6 |
| 9,290,882 | B2 * | 3/2016 | Batt | D06F 23/04 |
| 2007/0130999 | A1 * | 6/2007 | Dominguez | D06F 37/24 68/12.24 |
| 2013/0276483 | A1 * | 10/2013 | Ryu | D06F 37/40 68/12.24 |
| 2013/0312462 | A1 * | 11/2013 | Kim | D06F 21/08 68/133 |
| 2014/0305173 | A1 * | 10/2014 | Berndsen | D06F 13/02 68/133 |

FOREIGN PATENT DOCUMENTS

| | | |
|---|---|---|
| CN | 103518014 | 1/2014 |
| CN | 103911797 | 7/2014 |
| JP | 6-304376 | 11/1994 |
| JP | 11-169593 | 6/1999 |
| JP | 2006-271891 | 10/2006 |
| KR | 10-1998-0041190 | 8/1998 |
| KR | 10-2000-0043385 | 7/2000 |

OTHER PUBLICATIONS

Chinese Office Action dated Jul. 7, 2017 in Chinese Patent Application No. 201510683466.0.
Chinese Office Action dated Dec. 28, 2017 in Chinese Patent Application No. 201510683466.0.
Chinese Notice of Allowance dated Apr. 19, 2018 in Chinese Patent Application No. 201510683466.0.

* cited by examiner

WASHING MACHINE AND METHOD FOR CONTROLLING THE SAME

CROSS-REFERENCE TO RELATED APPLICATIONS

This application claims the priority benefit of Korean Patent Application No. 10-2014-0087550, filed on Jul. 11, 2014, and Korean Patent Application No. 10-2014-0124970, filed on Sep. 19, 2014, in the Korean Intellectual Property Office, the disclosures of which are incorporated herein by reference.

BACKGROUND

1. Field

The following description relates to a washing machine having a clutch device that alternatively transmits driving power of a motor only to a pulsator or simultaneously transmits the driving power of the motor to a pulsator and a rotary tub, and a method for controlling the same.

2. Description of the Related Art

A washing machine is a household appliance that washes and dehydrates laundry using electric power. The washing machine includes a main body forming the external appearance of the washing machine; a tub arranged in the main body to contain wash water therein; a rotary tub rotatably mounted in the tub to accommodate laundry therein; a pulsator rotatably arranged below the rotary tub to generate a water current so that laundry is washed; a motor to generate driving power; a washing shaft to transmit the driving power of the motor to the pulsator; and a dehydration shaft supporting the rotary tub and having a hollow portion in which a washing shaft is inserted.

In a washing process of the washing machine, if the motor is driven, the driving power of the motor is applied to the pulsator through the washing shaft, and the laundry can be washed by the water current generated by rotation of the pulsator. In the dehydration process of the washing machine, if the motor is driven, the driving power of the motor is applied to the pulsator and the rotary tub through the washing shaft and the dehydration shaft, so that the pulsator and the rotary tub simultaneously rotate to dehydrate the laundry.

For this purpose, the washing machine includes a clutch device configured to alternatively transmit the driving power of the motor only to the pulsator or to simultaneously transmit the driving power of the motor to the pulsator and the rotary tub.

SUMMARY

Therefore, it is an aspect of the disclosure to provide a washing machine having a clutch device that can be power-switched using only buoyancy of wash water without using a separate actuator.

It is an aspect of the disclosure to provide a washing machine having a simplified clutch device using a shape of a conventional pulsator.

It is an aspect of the disclosure to provide a washing machine having a buoyancy clutch device having increased reliability in operation.

Additional aspects of the invention will be set forth in part in the description which follows and, in part, will be obvious from the description, or may be learned by practice of the disclosure.

In accordance with an aspect of the disclosure, a washing machine includes: a tub configured to accommodate wash water therein; a rotary tub rotatably mounted in the tub; a pulsator rotatably arranged below the rotary tub, configured to form a water current; a motor configured to provide driving power to the pulsator; and a floater configured to ascend or descend in response to a water level of the wash water in such a manner that the pulsator and the rotary tub interact with each other or the interaction therebetween is released. The pulsator includes a reinforcement rib protruding from a bottom surface of the pulsator to reinforce stiffness, and the floater is connected to the reinforcement rib in a manner that the floater ascends or descends along the reinforcement rib.

The floater may include a guide groove in which the reinforcement rib is inserted so that the floater ascends or descends along the reinforcement rib.

The reinforcement rib may be configured in a radial form.

The reinforcement rib may be extended from a shaft coupling unit of the pulsator to a flange portion of the pulsator.

The pulsator may include: an edge rib protruding from a bottom surface of the pulsator, configured to be formed along a circumferential direction at a flange portion of the pulsator, wherein the reinforcement rib is supported by closely contacting the edge rib.

The pulsator may include: an inner rib and an outer rib, which protrude from a bottom surface of the pulsator, and are configured to respectively support an inner lateral surface and an outer lateral surface of the floater.

The reinforcement rib may be configured to cross the inner rib and the outer rib.

The pulsator may include a floater accommodation space formed among the reinforcement rib, the inner rib, and the outer rib to accommodate the floater therein.

The floater accommodation space may be sealed to prevent permeation of foreign materials when the floater ascends.

The floater may include an inner flange portion and an outer flange portion which are configured to closely contact the inner rib and the outer rib, respectively, to seal the floater accommodation space when the floater ascends.

The pulsator may include air discharge holes through which air of the floater accommodation space is leaked outside when the floater ascends.

The floater may be line-contacted with the reinforcement rib.

The floater may include a convex portion configured to protrude toward the reinforcement rib so that the floater is line-contacted with the reinforcement rib.

The pulsator may include: an auxiliary guide rail formed in at least one of the reinforcement rib, the inner rib, and the outer rib to guide the ascending and descending movement of the floater.

The floater may include: a rail groove in which the auxiliary guide rail is inserted in such a manner that the floater ascends or descends along the auxiliary guide rail.

The washing machine may further include: a coupler which is separated from the floater when the floater ascends, and is connected to the floater when the floater descends so that the coupler receives rotational force.

The washing machine may further include: a flange shaft including a drive flange coupled to the rotary tub and a dehydration shaft rotatably supporting the drive flange, wherein the coupler is fixed to the drive flange.

The floater may include a floater interaction unit formed at a bottom surface of the floater, configured to be coupled to the coupler when the floater descends so that the rotational force is applied to the coupler. The coupler may include a coupler interaction unit which is connected to the floater interaction unit when the floater descends to receive the rotational force.

The floater interaction unit may include interaction teeth protruding from the bottom surface of the floater.

The interaction teeth may include tilted surfaces respectively formed at a left region and a right region on the basis of a center line arranged in a radial direction.

The coupler interaction unit may include an interaction slot in which the interaction teeth are inserted.

The coupler may include a guide surface obliquely formed between the neighboring interaction slots that are configured to direct the interaction teeth toward the interaction slot when the floater descends.

The coupler may include: a water-drain passage configured to drain wash water from the interaction slot to the outside.

The coupler interaction unit may include correspondence teeth configured to be meshed with the interaction teeth when the floater descends.

In accordance with an aspect of the disclosure, a washing machine includes: a tub configured to accommodate wash water therein; a rotary tub rotatably mounted in the tub; a pulsator rotatably arranged below the rotary tub, configured to form a water current; a motor configured to provide driving power to the pulsator; and a floater coupled to a bottom surface of the pulsator, configured to ascend or descend in response to a water level of the wash water in such a manner that the pulsator and the rotary tub interact with each other or the interaction therebetween is released, wherein the pulsator includes a floater accommodation space formed at the bottom surface of the pulsator to accommodate the floater therein, and where the floater accommodation space is sealed by the floater when the floater ascends.

The pulsator may include: a reinforcement rib configured to protrude from the bottom surface of the pulsator and formed in a radial shape; and an inner rib and an outer rib protruding from the bottom surface of the pulsator, configured to be formed along a circumferential direction to respectively support an inner lateral surface and an outer lateral surface of the floater, wherein the floater accommodation space is formed by the reinforcement rib, the inner rib, and the outer rib.

The floater may include an inner flange portion and an outer flange portion which are configured to closely contact the inner rib and the outer rib, respectively, to seal the floater accommodation space when the floater ascends.

The pulsator may include air discharge holes through which air of the floater accommodation space is leaked outside when the floater ascends.

In accordance with an aspect of the disclosure, a washing machine includes: a tub configured to accommodate wash water therein; a rotary tub rotatably mounted in the tub; a pulsator rotatably arranged below the rotary tub, configured to form a water current; a motor configured to generate driving power; a drain device configured to discharge wash water of the tub to the outside; a water level detection unit configured to detect a water level of the tub; an input unit configured to receive a user command; a floater mounted in the tub, configured to ascend or descend in response to the water level of the tub to transmit the driving power of the motor to the pulsator and the rotary tub; and a controller, if a power-off command for powering off the washing machine or a stop command for stopping the washing machine is input to the input unit, configured to operate the drain device in response to the tub water-level detected by the water level detection unit.

If the power-off command of the washing machine is input to the input unit, the controller may determine whether the tub water-level is higher than a predetermined reference water level. If the tub water-level is higher than the predetermined reference water level, the controller may drain the wash water from the tub by operating the drain device and then powers off the washing machine.

If the stop command of the washing machine is input to the input unit, the controller may count a time elapsed after reception of the stop command. If a predetermined time elapses, the controller may determine whether the tub water-level is higher than a predetermined reference water level. If the tub water-level is higher than the predetermined reference water level, the controller may drain wash water from the tub by operating the drain device.

In accordance with an aspect of the disclosure, a method for controlling a washing machine includes: receiving a power-off command or a stop command from a user; detecting a water level of the tub; determining whether the water level of the tub is higher than a predetermined reference water level; and if the water level of the tub is higher than the predetermined reference water level, draining wash water from the tub to the outside.

The method may further include: after the wash water of the water is completely drained to the outside, powering the washing machine off.

The method may further include: counting a time elapsed after receiving the stop command from the user; and detecting a water level of the tub after lapse of a predetermined time.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
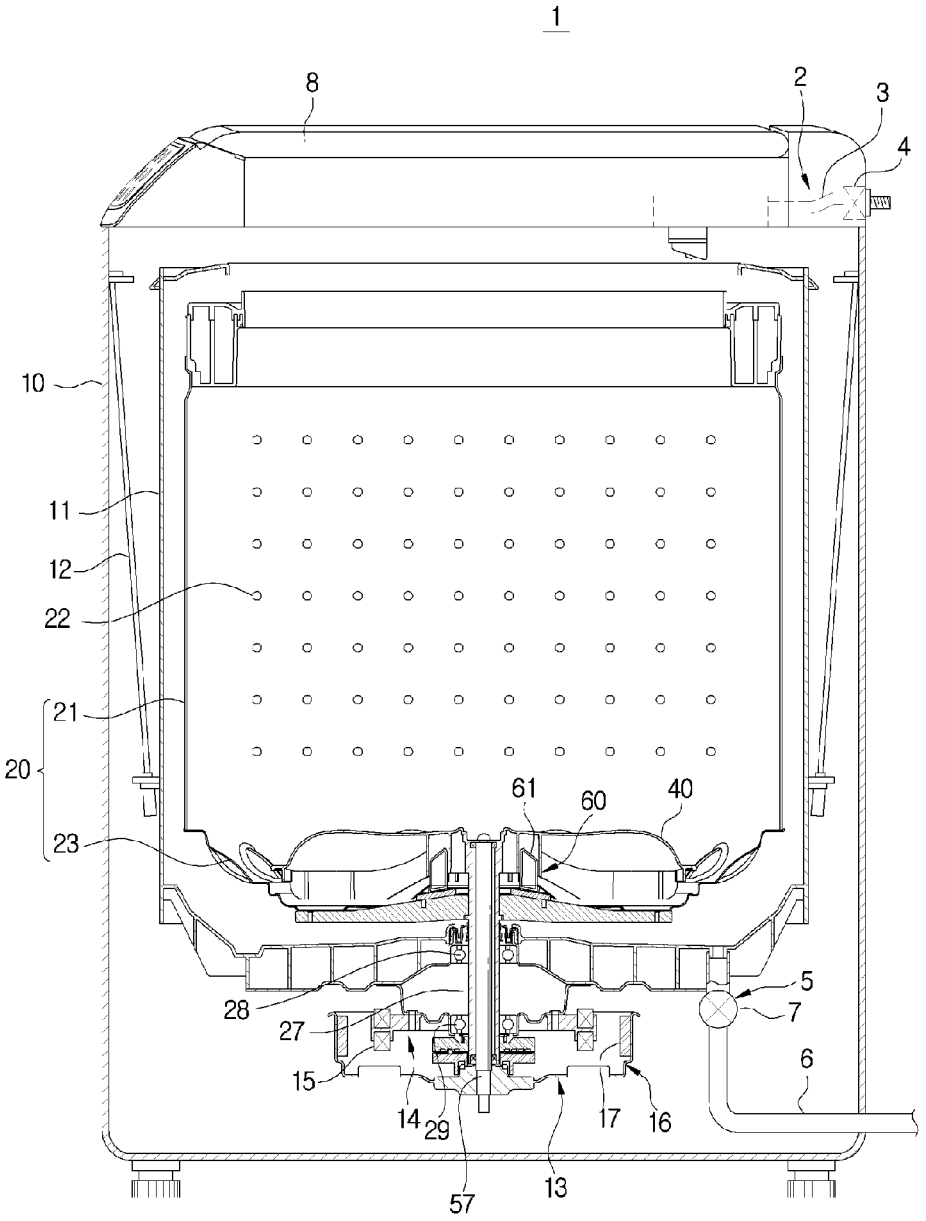
FIG. 1 is a cross-sectional view illustrating a washing machine according to an embodiment of the disclosure.

Reference will now be made in detail to the embodiments of the disclosure, examples of which are illustrated in the accompanying drawings, wherein like reference numerals refer to like elements throughout.

Figure 2:
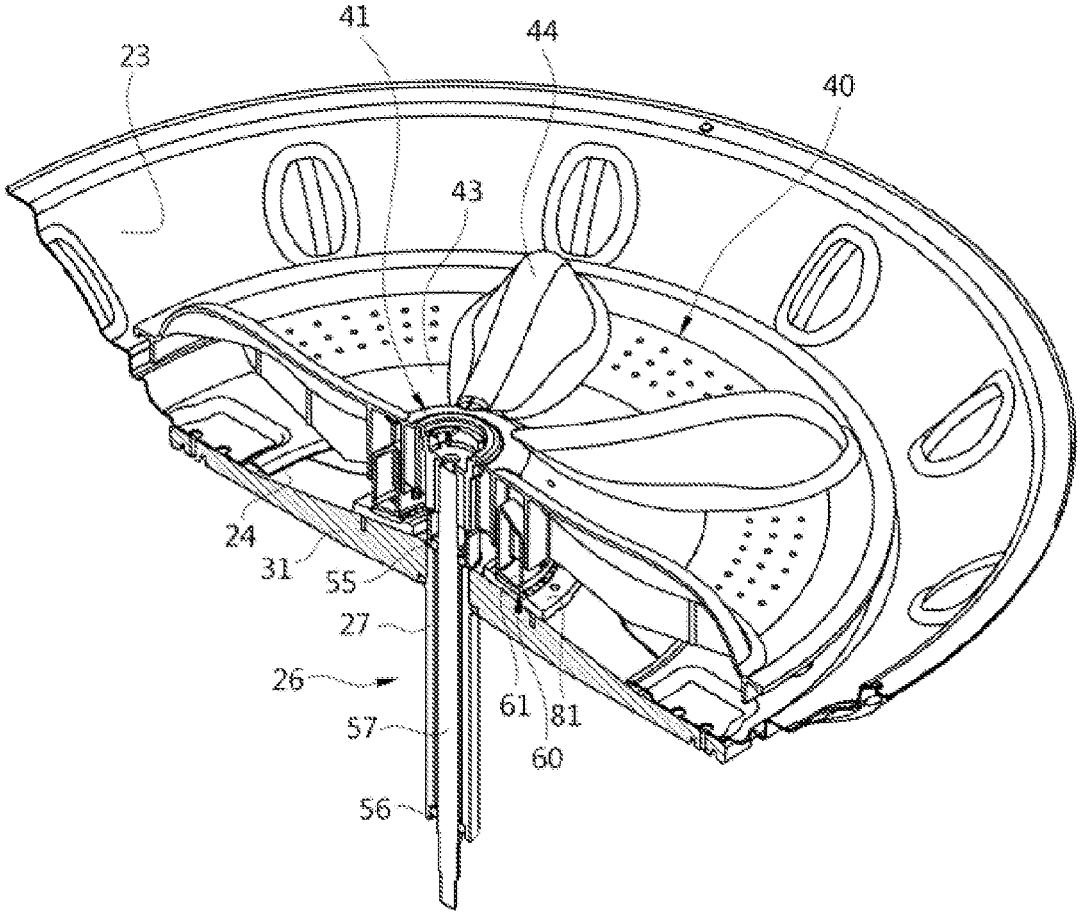
FIG. 2 is a cross-sectional view illustrating a clutch device for use in the washing machine shown in FIG. 1.
Figure 3:
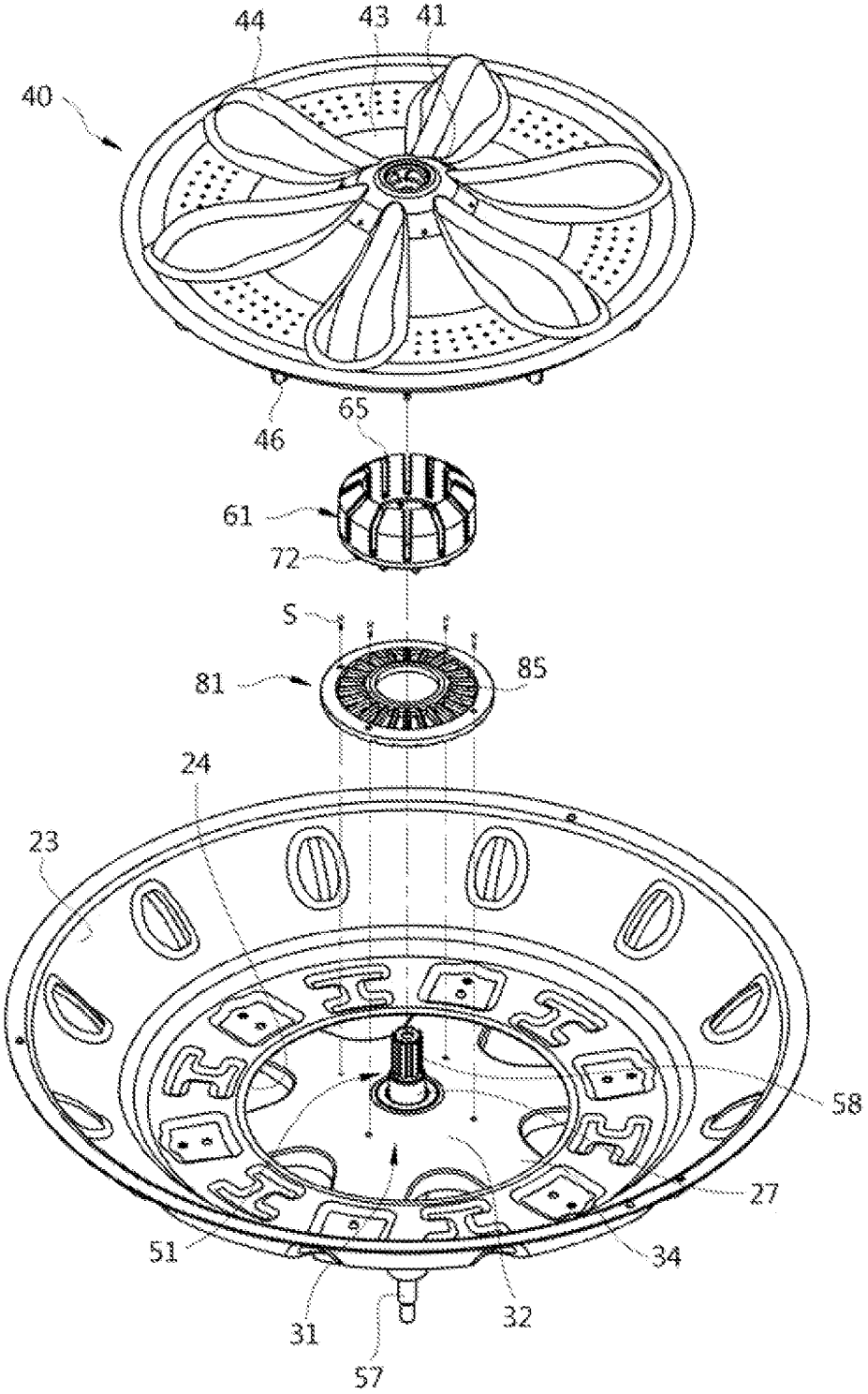
FIG. 3 is an exploded perspective view illustrating a clutch device of the washing machine shown in FIG. 1.
Figure 4:
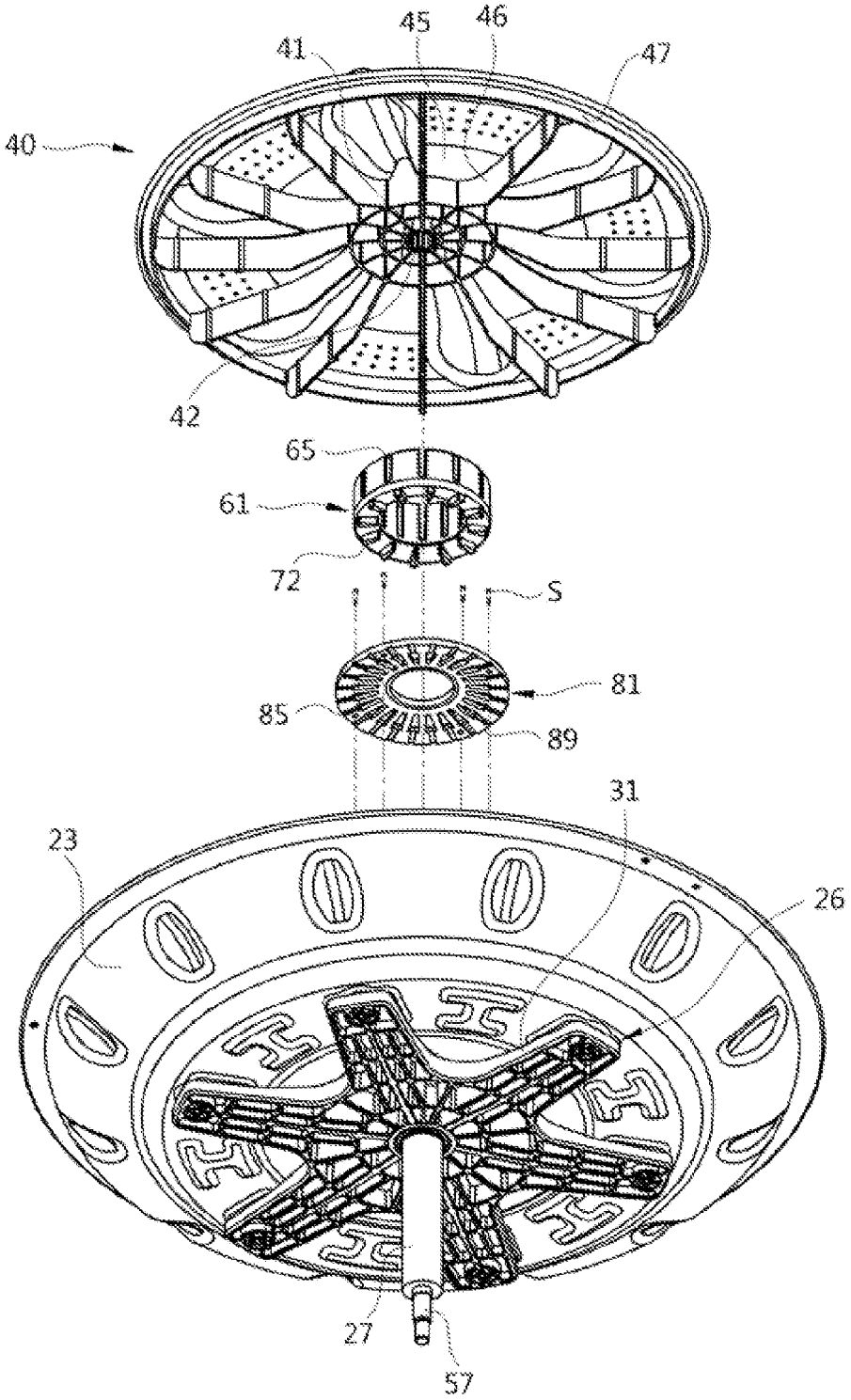
FIG. 4 is an exploded bottom perspective view illustrating a clutch device of the washing machine shown in FIG. 1.

FIG. 1 is a cross-sectional view illustrating a washing machine according to an embodiment of the disclosure. FIG. 2 is a cross-sectional view illustrating a clutch device for use in the washing machine shown in FIG. 1. FIG. 3 is an exploded perspective view illustrating a clutch device of the washing machine shown in FIG. 1. FIG. 4 is an exploded bottom perspective view illustrating a clutch device of the washing machine shown in FIG. 1.

Referring to FIGS. 1 to 4, the washing machine 1 includes a main body 10 forming the external appearance of the washing machine; a tub 11 arranged in the main body 10 to contain wash water therein; a rotary tub 20 rotatably mounted in the tub 11; a pulsator 40 rotatably installed below the rotary tub 20 to generate a water current; a motor 13 to generate driving power; and a clutch device 60 configured to alternatively transmit the driving power of the motor 13 only to the pulsator 40 or to simultaneously transmit the driving power of the motor 13 to the pulsator 40 and the rotary tub 20.

The main body 10 may have a box shape, the top of which is open. A door 8 may be coupled to the main body 10 to open or close the opened top surface. The door 8 may be hinge-coupled to the main body 10 so that the door 8 can be rotated.

The tub 11 may be mounted in the main body 10 through a suspension system 12. The tub 11 may have a substantially cylindrical shape. A water supply device 2 for providing wash water to the tub 11 may be provided above the tub 11, and a drain device 5 for discharging wash water of the tub 11 to the outside of the main body 10 may be provided below the tub 11. The water supply device 2 may include a water supply pipe 3 connected to an external water supply source, and a water supply valve 4 configured to open or close the water supply pipe 3. The drain device 5 may include a drain pipe 6 and a drain valve 7 configured to open/close the drain pipe 6.

The rotary tub 20 may include a cylindrical unit 21 having a cylindrical shape and a bowl unit 23 coupled to a lower part of the cylindrical unit 21. A through-hole 22 through which wash water can be supplied to or drained from the tub 11 may be formed in the cylindrical unit 21. The bowl unit 23 may form the bottom of the rotary tub 20, and may have a hollow portion 24 through which the washing shaft 57 and the dehydration shaft 27 pass.

The motor 13 may have a stator 14 fixed to the bottom of the tub 11, and a rotor 16 configured to rotate in a forward or backward direction by interacting with the stator 14. The rotor 16 may be arranged at an external part of a radial direction of the stator 14. The stator 14 may include a coil 15 configured to generate a magnetic field upon receiving a current, and the rotor 16 may include a magnet 17 configured to interact with the coil 14. A lower end of the washing shaft 57 is coupled to the center portion of the rotor 16, so that the washing shaft 57 may rotate with rotation of the rotor 16. If the rotor 16 rotates, the washing shaft 57 may also rotate along with the rotating rotor 16. The pulsator 40 for generating a water current may be coupled to an upper end of the washing shaft 57. Therefore, the washing shaft 57 may transmit rotational power generated from the motor 13 to the pulsator 40. The washing shaft 57 may be rotatably supported by the bearings (28, 29) shown in FIG. 1.

The pulsator 40 may be rotatably arranged below the rotary tub 20. The pulsator 40 may be rotatably supported by the washing shaft 57. The pulsator 40 may have a substantially disc shape. A shaft coupling unit 41 coupled to the washing shaft 57 may be arranged at the center portion of the pulsator 40. Saw-toothed serrations 42 may be formed at an inner lateral surface of the shaft coupling unit 41, and saw-toothed serrations 58 may be formed at an outer lateral surface of the washing shaft 57 so that the saw-toothed serrations 58 can be coupled to the saw-toothed serrations 42.

A rotary wing 44 may be formed in a radial direction at the top surface 43 of the pulsator 40 so that the water current can be generated during rotation of the pulsator 40. A reinforcement rib 46 for reinforcing stiffness of the pulsator 40 may be formed at the bottom surface 45 of the pulsator 40. A detailed description of the reinforcement rib 46 will be given below.

The washing shaft 57 may be provided in the dehydration shaft 27. That is, the dehydration shaft 27 may have a hollow portion, and the washing shaft 57 may be inserted into the hollow portion of the dehydration shaft 27. The washing shaft 57 may be longer than the dehydration shaft 27. The bearings (55, 56) shown in FIG. 2 may be arranged between the washing shaft 57 and the dehydration shaft 27.

The flange shaft 26 shown in FIG. 2 may include a dehydration shaft 27 and a drive flange 31. The dehydration shaft 27 and the drive flange 31 may be provided separately from each other, and the dehydration shaft 27 and the drive flange 31 may be coupled to each other as necessary. Alternatively, the dehydration shaft 27 and the drive flange 31 may be integrated with each other.

The drive flange 31 may include a hub unit 32 (shown in FIG. 3) fixedly coupled to the dehydration shaft 27; and an arm unit 34 (shown in FIG. 3) extended to the outside of the radial direction in the hub unit 32, and fixedly coupled to the bowl unit 23 of the rotary tub 20. The arm unit 23 may be strongly fixed to the bowl unit 23 of the rotary tub 20 through a coupling member such as screws. Although 6 arm units 34 are shown in the embodiment for convenience of description and better understanding of the disclosure, the number of arm units 34 is not limited thereto, and may be changed to another number as necessary. By the above-mentioned configuration, the flange shaft 26 may rotatably support the rotary tub 20, and the rotary tub 20 may be maintained in a freely rotated state.

The clutch device 60 may alternatively transmit the driving power of the motor 13 only to the pulsator 40, or may transmit the driving power of the motor 13 to the pulsator 40 and the rotary tub 20. The clutch device 60 includes a floater 61 which is disposed between the pulsator 40 and the flange shaft 26 in such a manner that the pulsator 40 interacts with the rotary tub 20 or interaction between the pulsator 40 and the rotary tub 20 is released, so that the clutch device 60 ascends or descends. That is, the floater 61 may ascend by buoyancy generated when the tub 11 is filled with wash water, and may descend by gravity when wash water is drained.

If a water level of the wash water contained in the tub 11 descends and the floater 61 descends, the pulsator 40 may interact with the rotary tub 20. On the contrary, if the water level of the wash water ascends and the floater 61 ascends, the interaction between the pulsator 40 and the rotary tub 20 may be released.

The floater 61 may be coupled to the reinforcement rib 46 of the pulsator 40 in such a manner that the floater 61 can ascend or descend along the reinforcement rib 46 of the pulsator 40. As described above, the floater 61 is coupled to the reinforcement rib 46 of the pulsator 40 in such a manner that the floater 61 can ascend or descend, so that an additional structure for coupling the floater 61 to the pulsator 40 need not be provided and the pulsator 40 may be simplified in structure. The coupling structure between the pulsator 40 and the floater 61 and the interaction structure between the pulsator 40 and the rotary tub 20 will hereinafter be described in detail.

Figure 5:
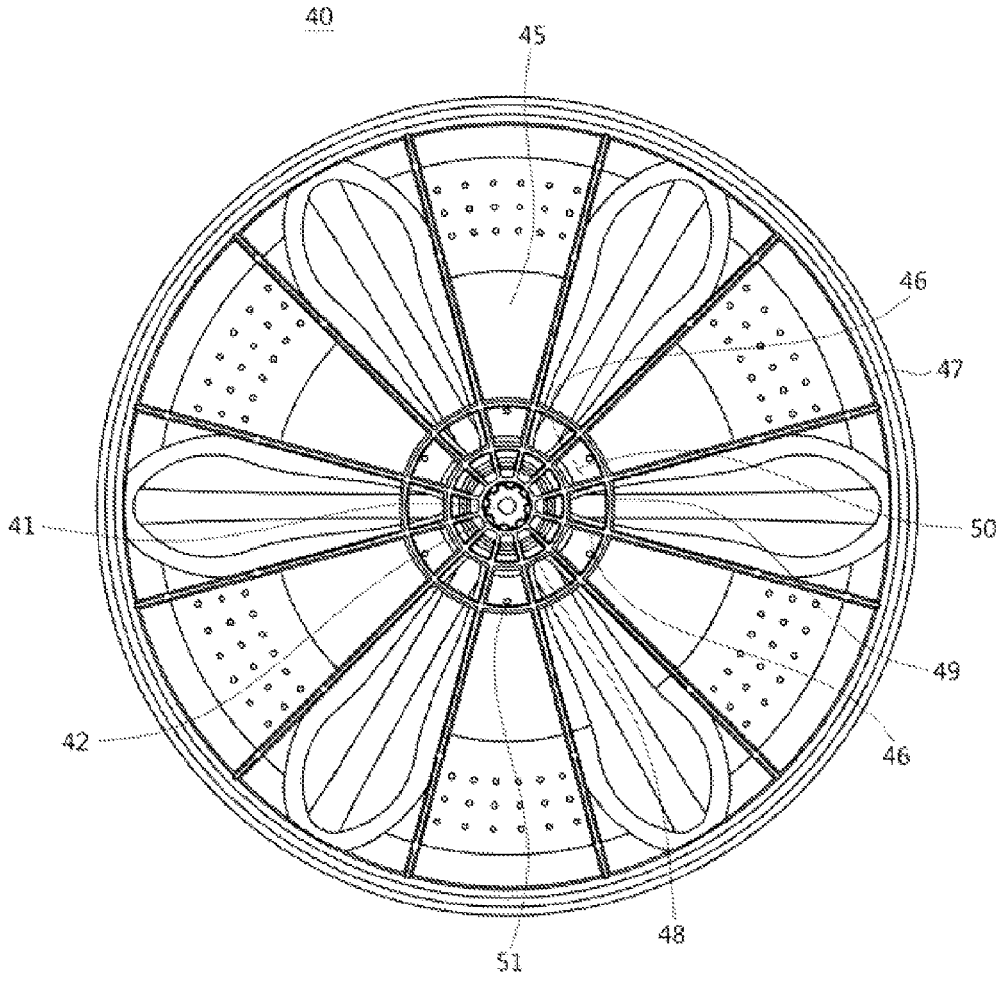
FIG. 5 is a bottom view illustrating a pulsator of the washing machine shown in FIG. 1.
Figure 6:
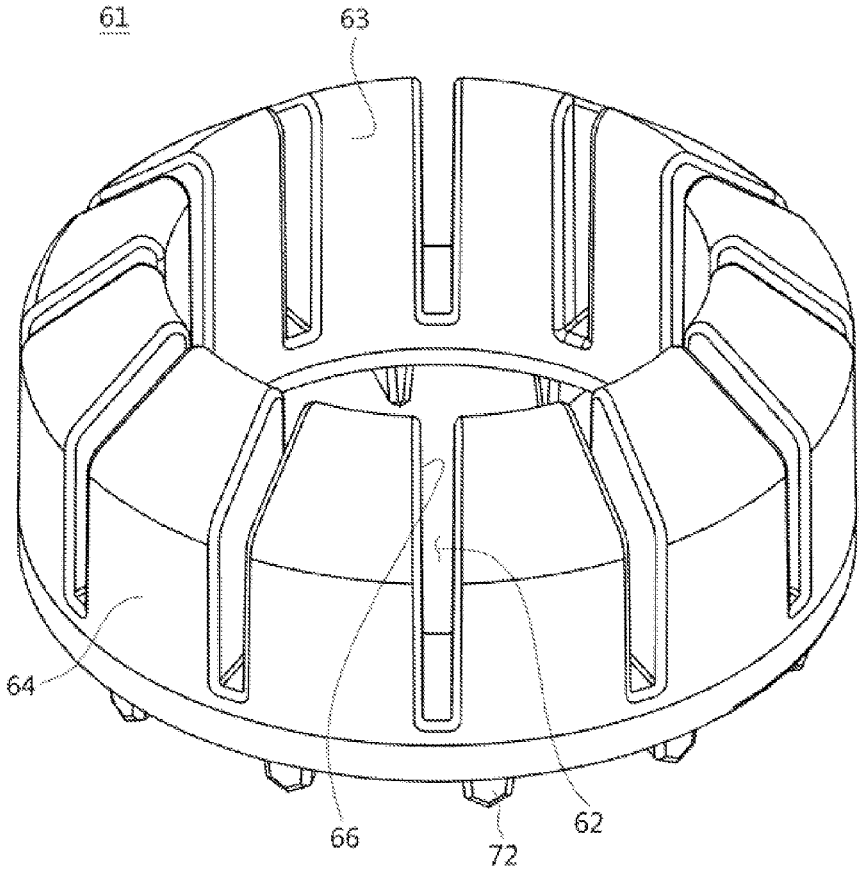
FIG. 6 is a perspective view illustrating a floater of the washing machine shown in FIG. 1.
Figure 7:
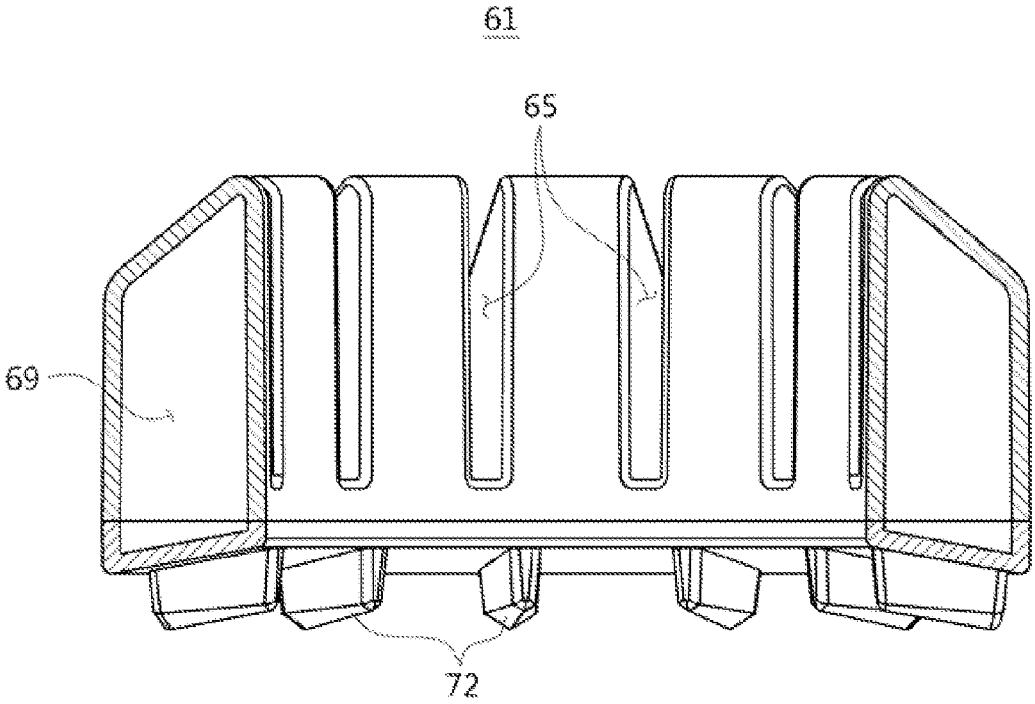
FIG. 7 is a cross-sectional view illustrating a floater of the washing machine shown in FIG. 1.
Figure 8:
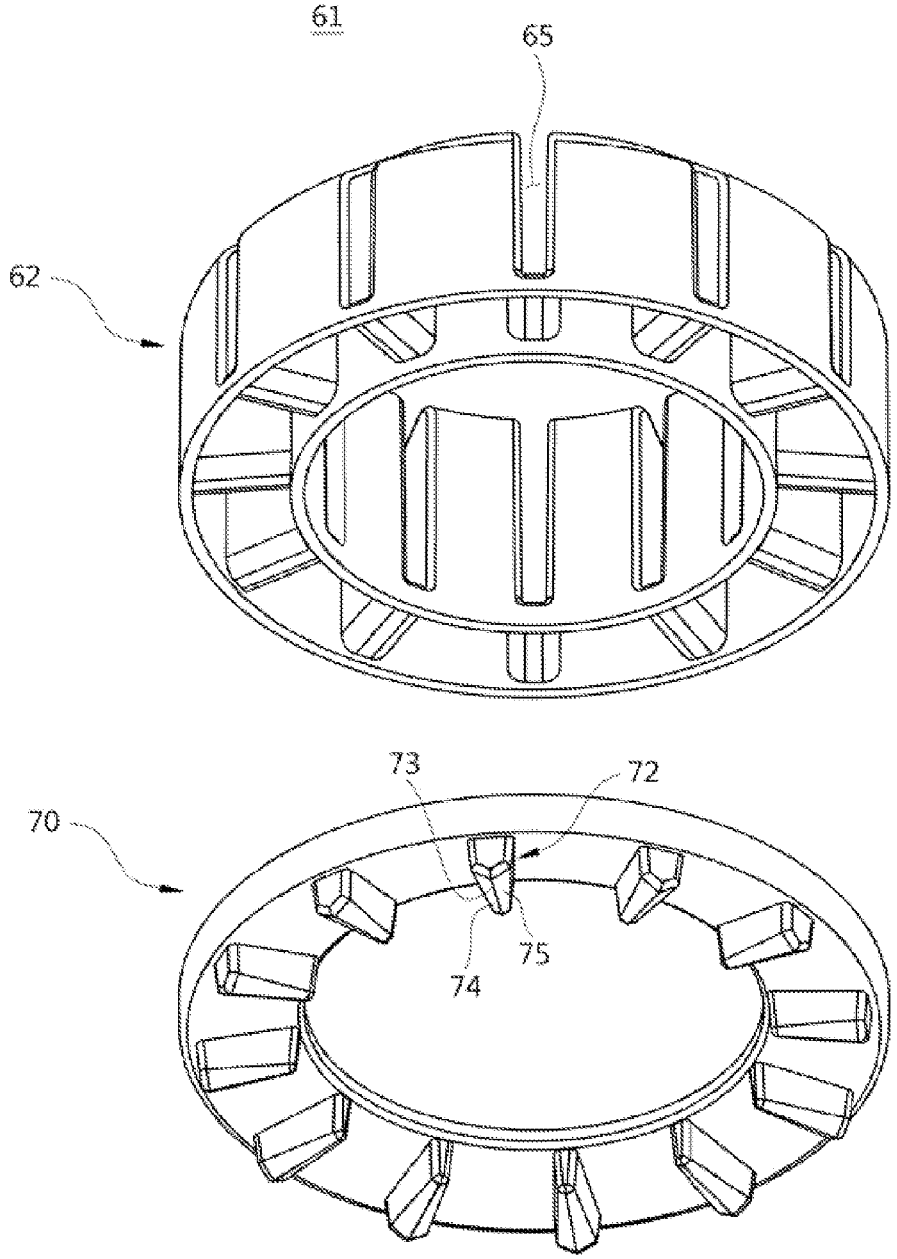
FIG. 8 is an exploded view illustrating the floater of the washing machine shown in FIG.
Figure 9:
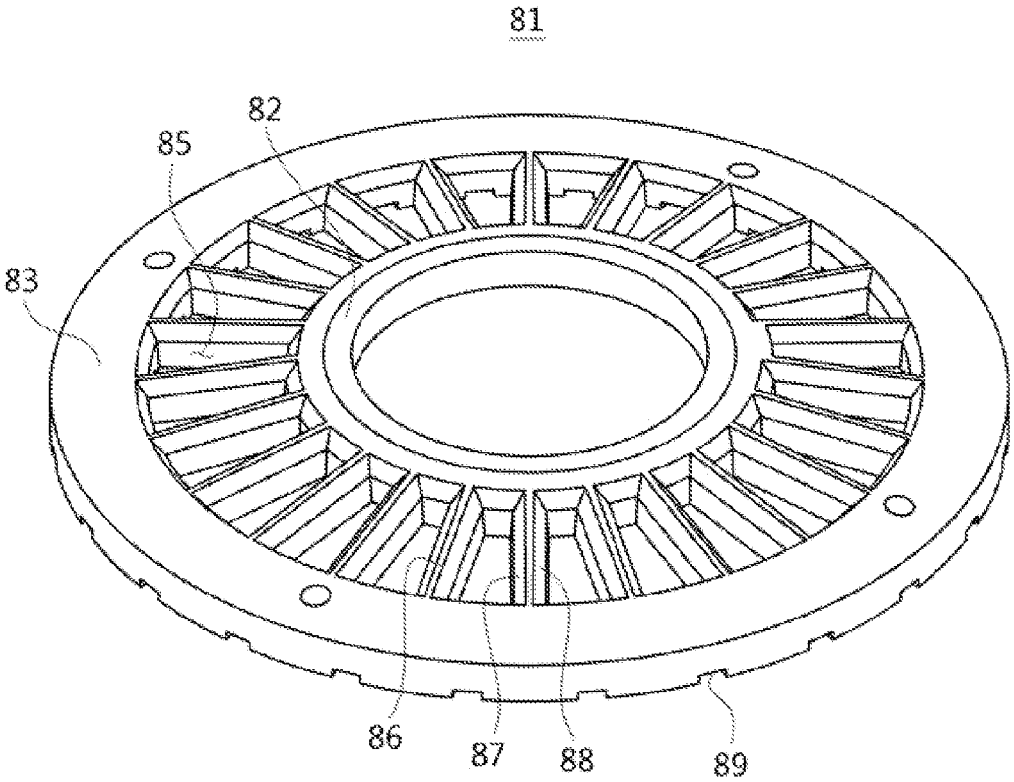
FIG. 9 is a schematic view illustrating a coupler and a flange shaft of the washing machine shown in FIG. 1.

FIG. 5 is a bottom view illustrating a pulsator of the washing machine shown in FIG. 1. FIG. 6 is a perspective view illustrating a floater of the washing machine shown in FIG. 1. FIG. 7 is a cross-sectional view illustrating a floater of the washing machine shown in FIG. 1. FIG. 8 is an exploded view illustrating the floater of the washing machine shown in FIG. 1. FIG. 9 is a schematic view illustrating a coupler and a flange shaft of the washing machine shown in FIG. 1.

Referring to FIGS. 5 to 8, the reinforcement rib 46 for reinforcing stiffness of the pulsator 40 may be formed at the bottom surface 45 of the pulsator 40. The reinforcement rib 46 may be integrated with the pulsator 40. The reinforcement rib 46 may protrude downward from the bottom surface 45 of the pulsator 40. The reinforcement rib 46 may be formed in a radial shape. That is, the reinforcement rib 46 may be extended outward along the radial direction of the shaft coupling unit 41 of the pulsator 40. The reinforcement rib 46 may be extended from the shaft coupling unit 41 of the pulsator 40 to a flange (or border) portion of the pulsator 40. The reinforcement rib 46 may be extended from the shaft coupling unit 41 of the pulsator 40 to the flange portion of the pulsator 40.

An edge rib 47 may be formed at the flange portion of the bottom surface 45 in a circumferential direction, and the reinforcement rib 46 may be supported by contacting the edge rib 47, resulting in higher stiffness of the reinforcement rib 46.

Although the above-mentioned embodiment has disclosed that the reinforcement rib 46 is formed in point symmetry on the basis of the shaft coupling unit 41, the scope or spirit of the disclosure is not limited thereto. Although the above-mentioned embodiment has exemplarily disclosed that 12 reinforcement ribs 46 are spaced apart from each other at intervals of a predetermined distance, the number of reinforcement ribs 46 is not limited thereto.

An inner rib 48 and an outer rib 49 may be formed at the inside of the bottom surface 45 of the pulsator 40 in the circumferential direction. The inner rib 48 and the outer rib 49 may form a concentric circle, and the outer rib 49 may have a larger radius than the inner rib 48.

The inner rib 48 and the outer rib 49 may cross the reinforcement rib 46. Therefore, the floater accommodation space 50 accommodating the floater therein may be formed by the inner rib 48 and the outer rib 49. Although the floater accommodation space 50 has exemplarily disclosed 12 floater accommodation spaces 50 arranged in the circumferential direction, the number of floater accommodation spaces 50 is not limited thereto.

The floater 61 may be accommodated in the floater accommodation space 50. Although the floater 61 ascends or descends, it is necessary for at least some parts of the floater 61 to be accommodated in the floater accommodation space 50. In more detail, at least some parts of the floater 61 must be accommodated in the floater accommodation space 50 during the descending operation of the floater 61, so that the rotational force of the pulsator 40 can be transmitted to the floater 61 through the reinforcement rib 46. By the above-mentioned construction, the floater 61 is locked to the rotation movement of the pulsator 40, so that the floater 61 can rotate along with the pulsator 40.

Figure 10:
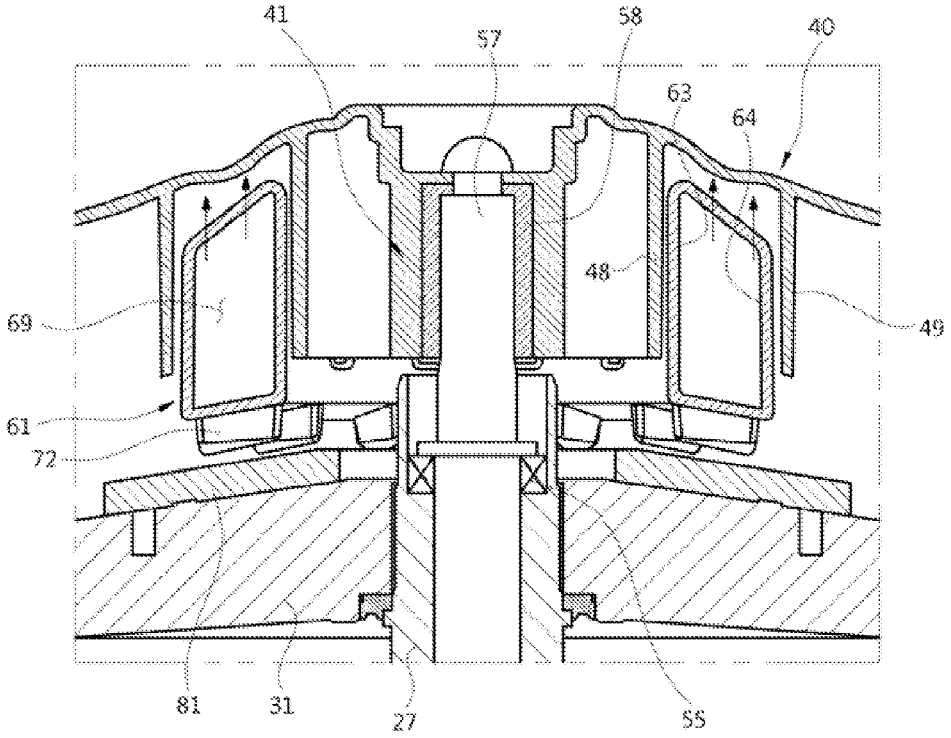
FIG. 10 is a schematic diagram illustrating operations of the floater for use in the washing machine shown in FIG. 1 so that the floater ascends in the washing process and the floater and the coupler are separated from each other.
Figure 11:
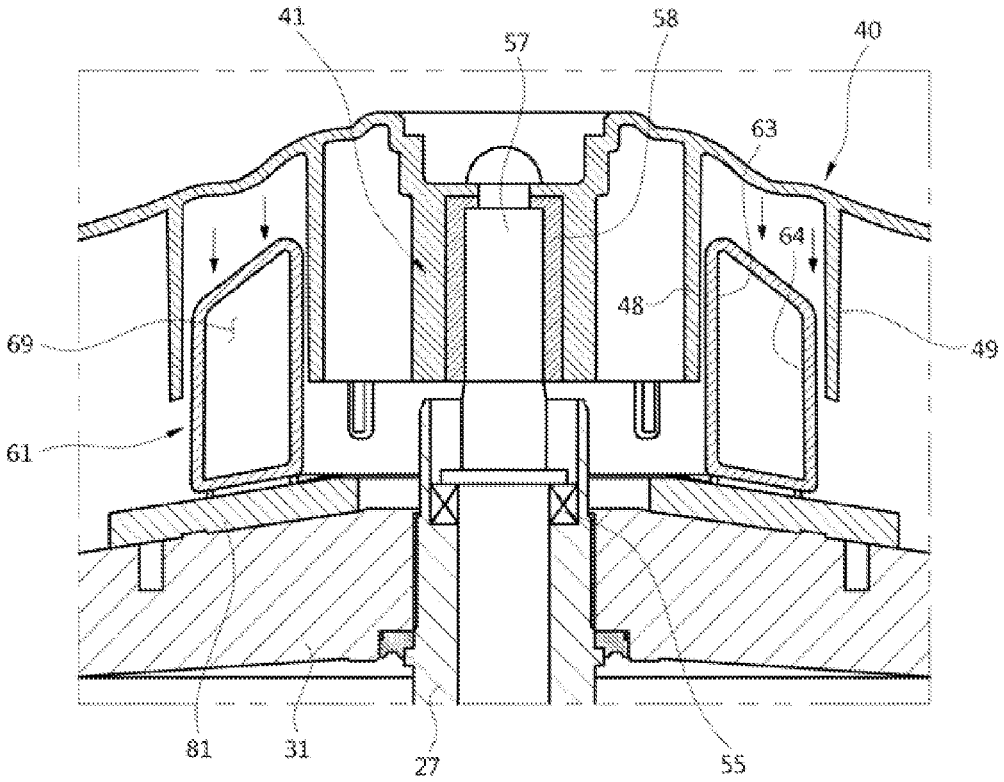
FIG. 11 is a schematic view illustrating operations of the floater for use in the washing machine shown in FIG. 1 so that the floater descends in a dehydration process and the floater and the coupler are coupled to each other.

The inner rib 48 may movably support the inner lateral surface 63, and the outer rib 49 may movably support the outer lateral surface 64, as shown in FIGS. 10 and 11.

When the floater 61 ascends in the floater accommodation space 50, air of the floater accommodation space 50 is discharged outside, so that an air discharge hole 51 (shown in FIG. 5) may be formed to facilitate the ascending movement of the floater 61.

The floater 61 may have a substantially cylindrical shape having a hollow portion through which the washing shaft 57 and the dehydration shaft 47 can pass. The floater 61 may ascend or descend along the reinforcement rib 46 of the pulsator 40, and may have a guide groove 65 in which the reinforcement rib 46 of the pulsator 40 is inserted in such a manner that the floater 61 may receive the rotational force from the reinforcement rib 46. As many guide grooves 65 as the number of reinforcement ribs 46 may be formed in the circumferential direction.

During rotation of the pulsator 40, the reinforcement rib 46 may pressurize the lateral portion 66 of the guide groove 65 of the floater 61, so that the floater 61 may rotate along with the pulsator 40. The reinforcement rib 46 and the guide-groove lateral portion 66 may be spaced apart from each other at intervals of a predetermined distance so that the floater 61 can easily ascend or descend. If an interval between the guide-groove lateral portion 66 and the reinforcement rib 46 is long in length, noise generated by collision becomes louder. If the interval between the guide-groove lateral portion 66 and the reinforcement rib 46 is short in length, it becomes difficult to perform the ascending or descending movement due to frictional force. For example, the guide-groove lateral portion 66 and the reinforcement rib 46 may be spaced apart from each other by intervals of approximately 0.2 mm to approximately 0.4 mm.

The floater 61 may be formed of various materials, such as resin, and an empty space 69 may be formed in the floater 61, so that the floater 61 can be reduced in weight.

The floater 61 may be formed in one body, or may be formed by combination of the upper floater 62 (shown in FIG. 8) and the lower floater 70 (shown in FIG. 8). The guide groove 65 may be formed in the upper floater 62, and the floater interaction unit to be described later may be formed in the lower floater 70.

The clutch device 60 may further include a coupler 81. During the ascending operation of the floater 61, the coupler 81 may be separated from the floater 61. During the descending operation of the floater 61, the coupler 81 is coupled to the floater 61 to receive the rotational force. The coupler 81 may be fixed to the drive flange 31 of the flange shaft 26. The coupler 81 may be strongly coupled to the drive flange 31 through the coupling member S such as a screw or the like.

The coupler 81 may have a substantially disc shape. The coupler 81 may have an inner flange portion 82 and an outer flange portion 83 which are formed in the circumferential direction.

The floater 61 may have a floater interaction unit that is coupled to the coupler 81 during the descending operation so that the rotational force can be transferred through the floater interaction unit. The coupler 81 may have a coupler interaction unit that is coupled to the floater interaction unit to receive the rotational force.

The floater interaction unit and the coupler interaction unit may have various coupling structures needed for power transmission. For example, the floater interaction unit may be interaction teeth 72 (shown in FIG. 8) protruding from the bottom surface of the floater 61, and the coupler interaction unit may be an interaction slot 85 (shown in FIG. 9) in which the interaction teeth 72 are inserted.

A predetermined number of interaction teeth 72 may be spaced apart from each other at intervals of a predetermined distance in the circumferential direction. A predetermined number of interaction slots 85 may be spaced apart from each other at intervals of a predetermined distance in the circumferential direction. The number of interaction teeth 72 need not be identical to the number of interaction teeth 85, and it is desirable that the number of interaction teeth 72 be higher than the number of interaction slots 85.

The interaction teeth 72 may include inclined surfaces (74, 75) respectively formed at the left and right regions on the basis of the center line 73 formed along the radial direction so that the interaction teeth 72 can be easily inserted into the interaction slot 85. In addition, the coupler 81 may have guide surfaces (87, 88) obliquely formed between the neighbor interaction slots 85 in such a manner that the interaction teeth 72 are directed to the interaction slot 85. The guide surfaces (87, 88) may be respectively formed at the left and right regions on the basis of the center line 86 formed in the radial direction. By the above-mentioned construction, during the descending operation of the floater 61, the interaction teeth 72 may be easily inserted into the interaction slot 85, irrespective of a relative position between the interaction teeth 72 and the interaction slot 85.

The coupler 81 may have a water-drain passage 89 through which the internal part and the external part of the interaction slot 85 communicate with each other so that wash water is not collected in the interaction slot 85 and leaked outside. The water-drain passage 89 may pass through the outer flange portion 83 of the coupler 81. The water-drain passage 89 is gradually tilted downward as it is located closer to the outermost position of the radial direction, so that wash water stored in the interaction slot 85 may flow through the water-drain passage 89 because of the weight of the wash water.

The water-drain passage 89 may be formed to pass through the inner flange portion 82 of the coupler 81, and may be gradually tilted downward as it is located closer to the innermost position of the radial direction. The interaction slot 85 having no wash water is maintained by the water-drain passage 89, so that the interaction teeth 72 of the floater 61 can be inserted into the interaction slot 85.

Although the coupler 81 is provided separately from the drive flange 31, it should be noted that the coupler 81 may also be integrated with the drive flange 31 without departing from the scope or spirit of the disclosure.

FIG. 10 is a schematic diagram illustrating operations of the floater for use in the washing machine shown in FIG. 1 so that the floater ascends in the washing process and the floater and the coupler are separated from each other. FIG. 11 is a schematic view illustrating operations of the floater for use in the washing machine shown in FIG. 1 so that the floater descends in a dehydration process and the floater and the coupler are coupled to each other.

The operations of the floater according to the embodiment will hereinafter be described with reference to FIGS. 10 and 11.

Referring to FIG. 10, during the washing process of the washing machine, if the tub is filled with water, the floater 61 ascends due to buoyancy thereof. The floater 61 may ascend along the reinforcement rib of the bottom surface of the pulsator 40. The inner lateral surface 63 and the outer lateral surface 64 of the floater 61 may be respectively directed by the inner rib 48 and the outer rib 49 of the bottom surface of the pulsator 40.

If the floater 61 ascends, the connection between the floater 61 and the coupler 81 is released, so that the interaction between the pulsator 40 and the rotary tub 20 may be released. Therefore, if the motor is driven, the rotational force is applied only to the pulsator 40 through the washing shaft 57, only the pulsator 40 rotates whereas the rotary tub 20 does not rotate.

As exemplarily shown in FIG. 11, if wash water is drained from the tub during the dehydration process of the washing machine, the floater 61 descends due to gravity. The floater 61 may descend along the reinforcement rib located at the bottom surface of the pulsator 40. The inner lateral surface 63 and the outer lateral surface 64 of the floater 61 may be respectively directed by the inner rib 48 and the outer rib 49 of the bottom surface of the pulsator 40. Although the floater descends, the floater 61 is not completely separated from the floater accommodation space 50. That is, although the floater 61 descends, the floater 61 may receive the rotational force through the reinforcement rib during the rotation of the pulsator 40, so that the floater 61 may rotate along with the pulsator 40.

As described above, if the floater 61 descends, the floater 61 is connected to the coupler 81, so that the pulsator 40 may interact with the rotary tub 20. Therefore, if the motor is driven, the rotational force is applied to the pulsator 40 through the washing shaft 57 so that the pulsator 40 rotates.

The rotational force of the pulsator 40 is also applied to the rotary tub 20, so that the pulsator 40 may rotate along with the rotary tub 20.

Figure 12:
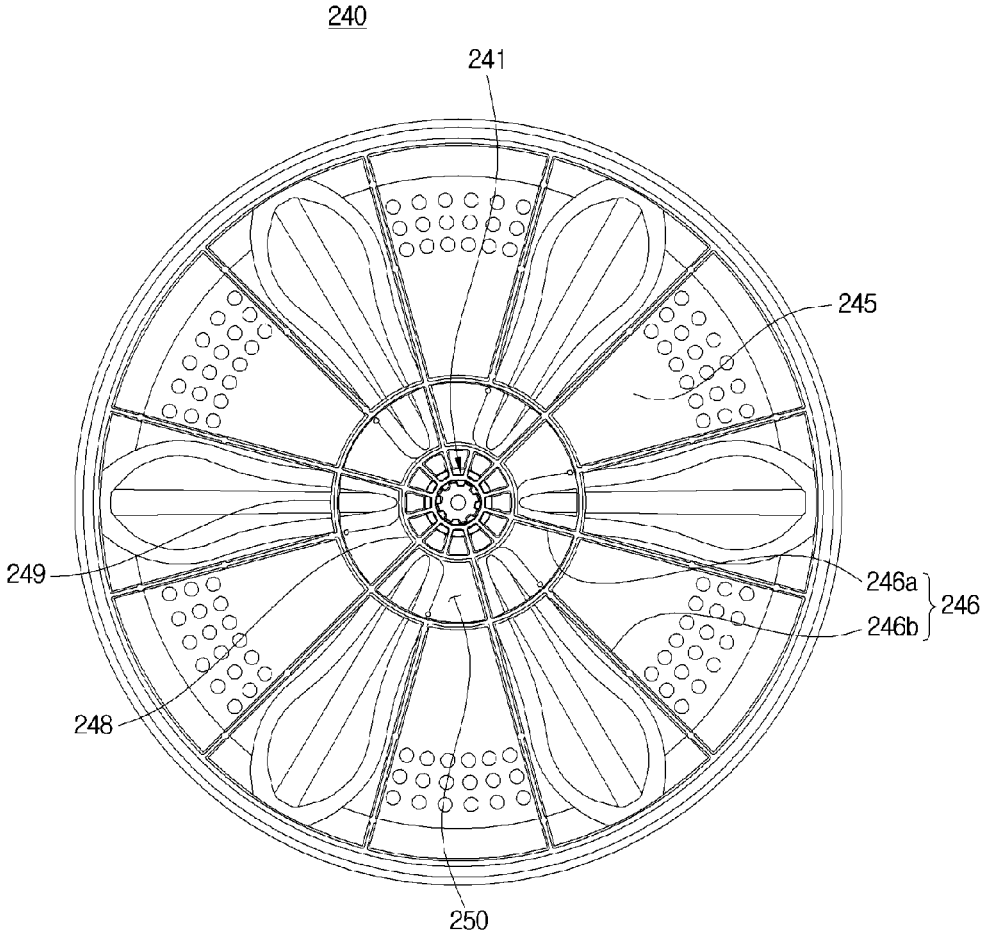
FIG. 12 is a bottom view illustrating a pulsator according to an embodiment of the disclosure.
Figure 13:
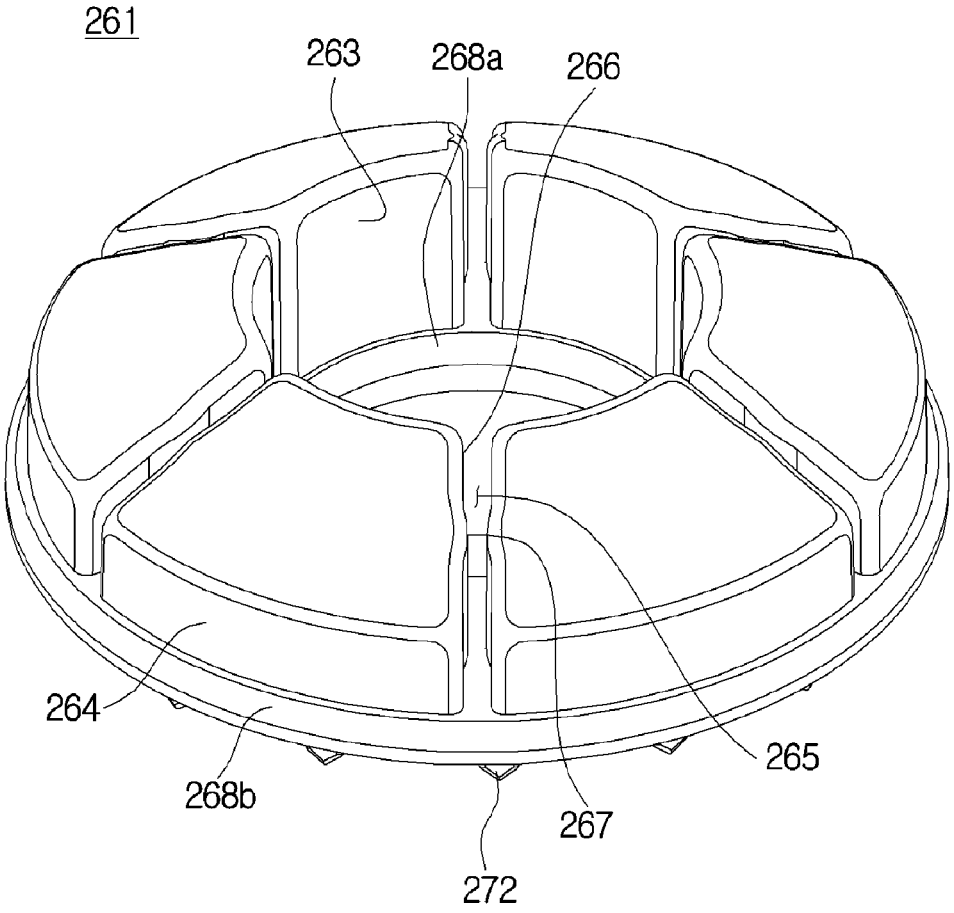
FIG. 13 is a schematic view illustrating a floater according to an embodiment of the disclosure.
Figure 14:
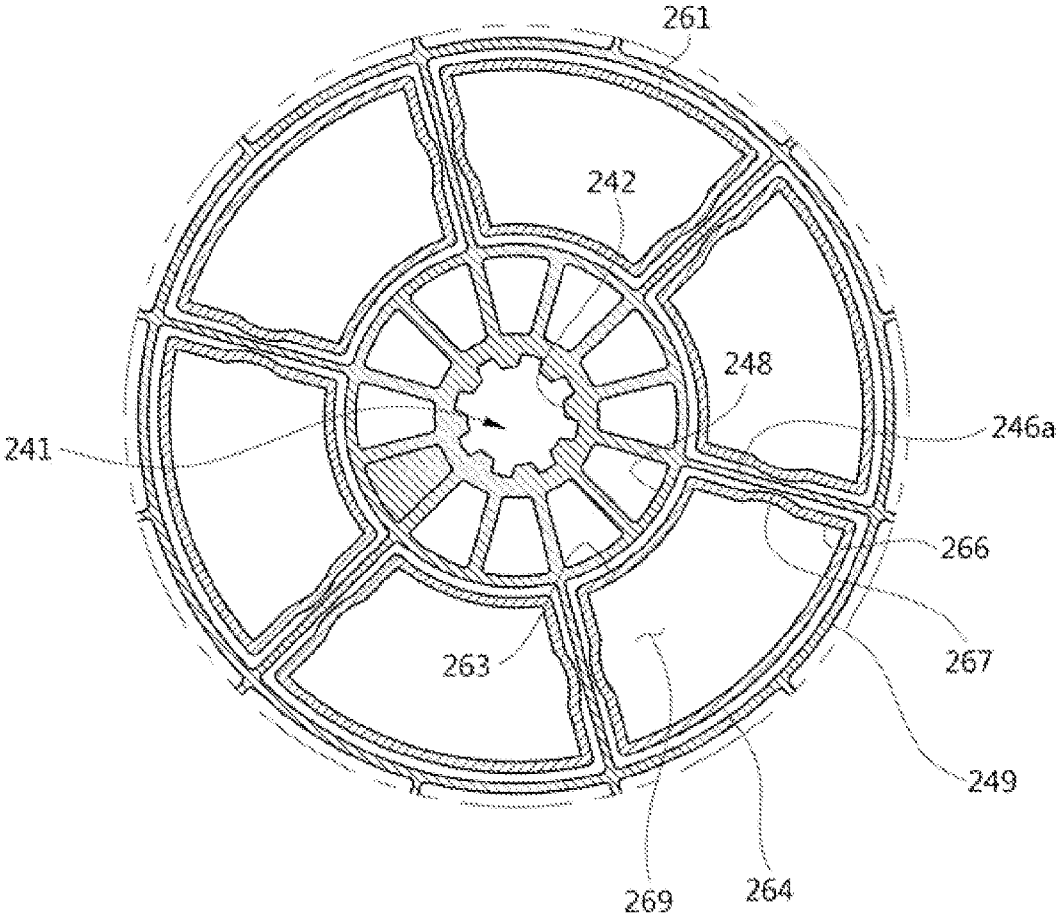
FIG. 14 is a planar cross-sectional view illustrating a line-contact structure of reinforcement ribs of the floater of FIG. 13 and the pulsator.
Figure 15:
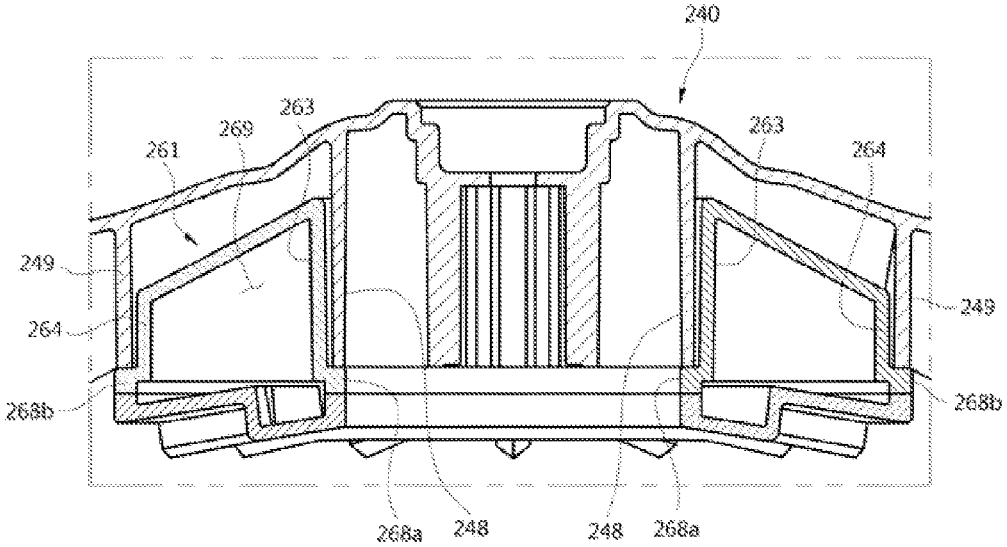
FIG. 15 is a lateral perspective view illustrating that the floater accommodation space of the pulsator is sealed by the floater of FIG. 13.
Figure 16:
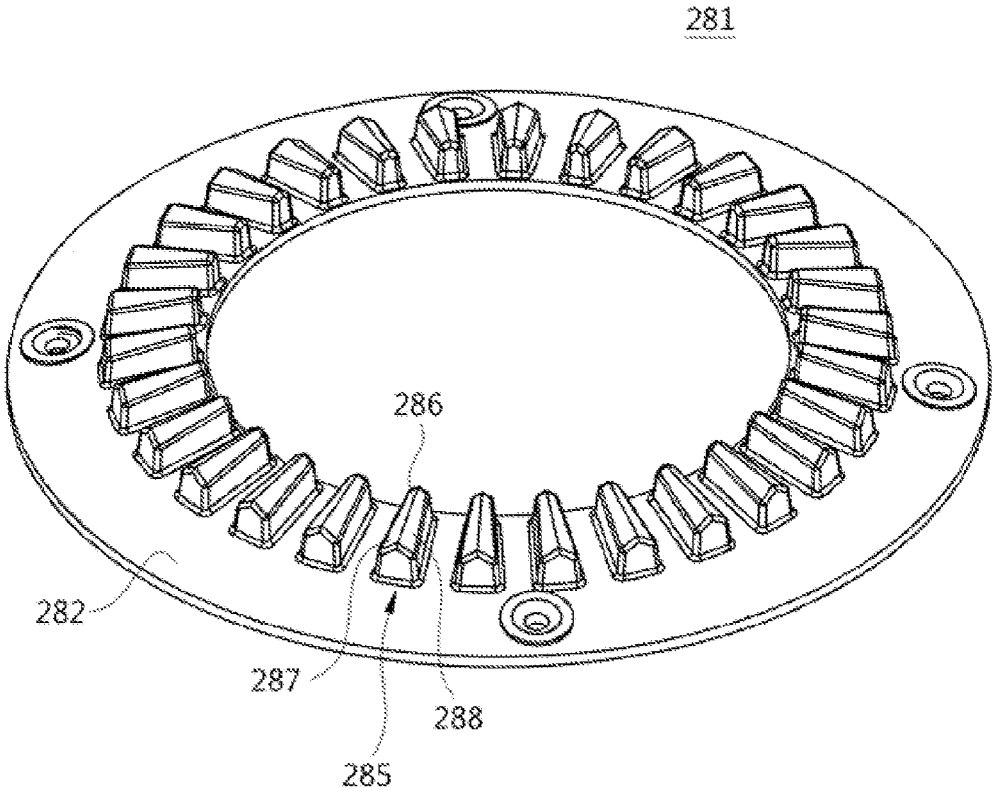
FIG. 16 is a schematic view illustrating a coupler according to an embodiment of the disclosure.

FIG. 12 is a bottom view illustrating a pulsator according to an embodiment of the disclosure. FIG. 13 is a schematic view illustrating a floater according to an embodiment of the disclosure. FIG. 14 is a planar cross-sectional view illustrating a line-contact structure of reinforcement ribs of the floater of FIG. 13 and the pulsator. FIG. 15 is a lateral perspective view illustrating that the floater accommodation space of the pulsator is sealed by the floater of FIG. 13. FIG. 16 is a schematic view illustrating a coupler according to an embodiment of the disclosure.

The pulsator, the floater, and the coupler according to an embodiment of the disclosure will hereinafter be described with reference to FIGS. 12 to 16. For convenience of description, the same or similar structures as those described in the above-mentioned embodiment are denoted by the same reference numerals, and explanation thereof will be omitted herein.

A reinforcement rib 246 for reinforcing stiffness of the pulsator 240 may be formed at the bottom surface 245 of the pulsator 240. The reinforcement rib 246 may protrude downward from the bottom surface 245 of the pulsator 240. The reinforcement rib 246 may be formed in a radial shape.

Some parts 246*a* of the reinforcement rib 246 may be successively extended from the shaft coupling unit 241 of the pulsator 240 to the flange portion of the pulsator 240. The remaining parts 246*b* of the reinforcement rib 246 may be formed only in the remaining section other than a specific section between the inner rib 248 and the outer rib 249. As a result, the number of floater accommodation spaces 250 formed among the reinforcement rib 246*a*, the inner rib 248 and the outer rib 249 may be half a total number of reinforcement ribs 246.

The floater 261 may have a guide groove 265 in which the reinforcement rib 246*a* of the pulsator 240 is inserted, so that the floater 261 can ascend or descend along the reinforcement rib 246*a* of the pulsator 240 and can receive the rotational force from the reinforcement rib 246*a* of the pulsator 240.

The lateral portion 266 of the guide groove 265 may be line-contacted with the reinforcement rib 246*a*. That is, the lateral portion 266 of the guide groove 265 may have a convex portion 267 protruding toward the reinforcement rib 246*a*. Although the convex portion 267 according to the embodiment is extended to the reinforcement rib 246*a* in a substantially vertical direction, the scope or spirit of the disclosure is not limited thereto, and it should be noted that the convex portion 267 may also be extended along in direction such as a horizontal or diagonal direction. Further, the convex portion 267 may be point-contacted with the reinforcement rib 246*a*.

As describe above, when the convex portion 267 is formed in the lateral portion 266 of the guide groove 265 so that the floater 261 is line-contacted with the reinforcement rib 246*a*, friction between the reinforcement rib 246*a* and the floater 261 is reduced, and thus noise is also reduced.

The convex portion 267 and the reinforcement rib 246*a* may be spaced apart from each other at intervals of a predetermined distance such that the convex portion 267 and the reinforcement rib 246*a* can easily ascend or descend. If an interval between the guide-groove lateral portion 66 and the reinforcement rib 46 is long in length, noise generated by collision becomes louder. If the interval between the guide-groove lateral portion 66 and the reinforcement rib 46 is short in length, it becomes difficult to perform the ascending or descending movement due to frictional force. For example, the convex portion 267 and the reinforcement rib 246*a* may be spaced apart from each other by intervals of approximately 0.2 mm to approximately 0.4 mm.

The floater 261 may include an inner flange portion 268*a* closely contacting the inner rib 248 of the pulsator 240 during the ascending operation, and an outer flange portion 268*b* closely contacting the outer rib 249 of the pulsator 240. The inner flange portion 268*a* may be extended inward of the radial direction at the inner lateral surface 263 of the floater 261. The outer flange portion 268*b* may be extended outward of the radial direction at the outer lateral surface 264 of the floater 261. The inner flange portion 268*a* and the outer flange portion 268*b* may be formed below the floater 261.

As exemplarily shown in FIG. 15, during the ascending operation of the floater 261, the inner flange portion 268*a* closely contacts the bottom surface of the inner rib 248, and the outer flange portion 268*b* closely contacts the bottom surface of the outer rib 249, the floater accommodation space 250 may be sealed. Therefore, lint contained in wash water is prevented from permeating the floater accommodation space 250, and operational reliability of the floater 261 may be increased.

The floater 261 may have a floater interaction unit that is connected to the coupler 281 during the descending operation so that the rotational force is transferred to the coupler 281. The coupler 281 may have a coupler interaction unit that is connected to the floater interaction unit to receive the rotational force.

The floater interaction unit and the coupler interaction unit may have various coupling structures capable of implementing power transmission. For example, the floater interaction unit may be the interaction teeth 272 protruding from the bottom surface of the floater 261, and the coupler interaction unit may be the correspondence teeth 285 meshed with the interaction teeth 272. The interaction teeth 272 may be identical to the other interaction teeth 72 of the above embodiment, and as such a detailed description thereof will be omitted herein for convenience of description.

The correspondence teeth 285 may be symmetrical in shape to the interaction teeth 272. The correspondence teeth 285 may protrude upward from the coupler body unit 282. The correspondence teeth 285 may include the corresponding tilted surfaces 287 and 288 respectively formed in the left and right parts on the basis of the center line 286 arranged in the radial direction. By the above-mentioned construction, during the descending operation of the floater 261, the teeth 285 may be meshed with the interaction teeth 272, irrespective of positions of the interaction teeth 272 and the correspondence teeth 285.

The floater 261 may be formed of various materials, such as resin, and an empty space 269 may be formed in the floater 261, so that the floater 261 can be reduced in weight.

Reference number 242 of FIG. 14 denotes serrations formed in the inner circumferential surface of the shaft coupling unit 241 of the pulsator 240 so that the serrations are coupled to the washing shaft.

Figure 17:
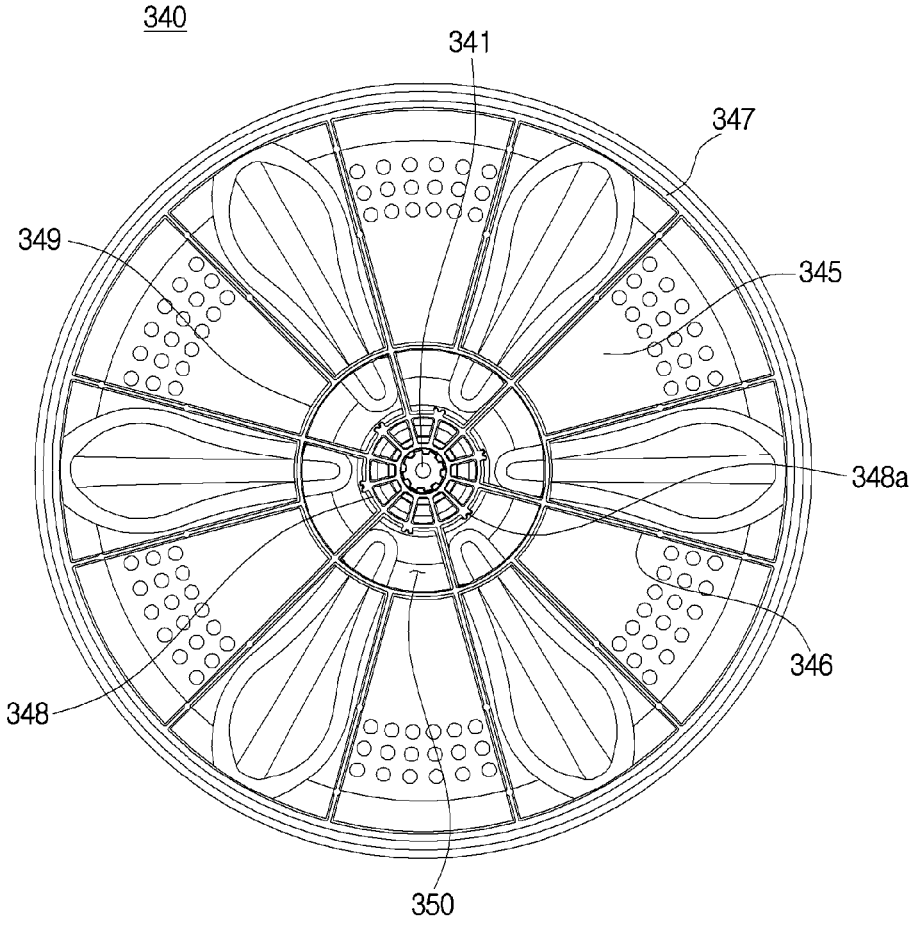
FIG. 17 is a bottom view illustrating a pulsator according to an embodiment of the disclosure.
Figure 18:
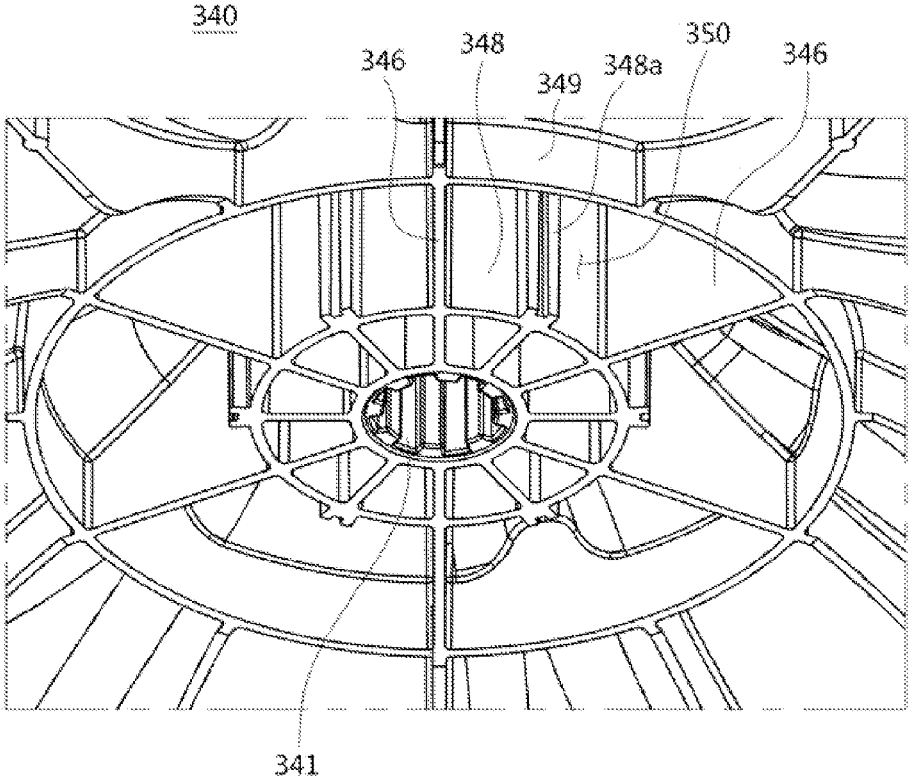
FIG. 18 is an enlarged bottom perspective view illustrating the pulsator of FIG. 17.
Figure 19:
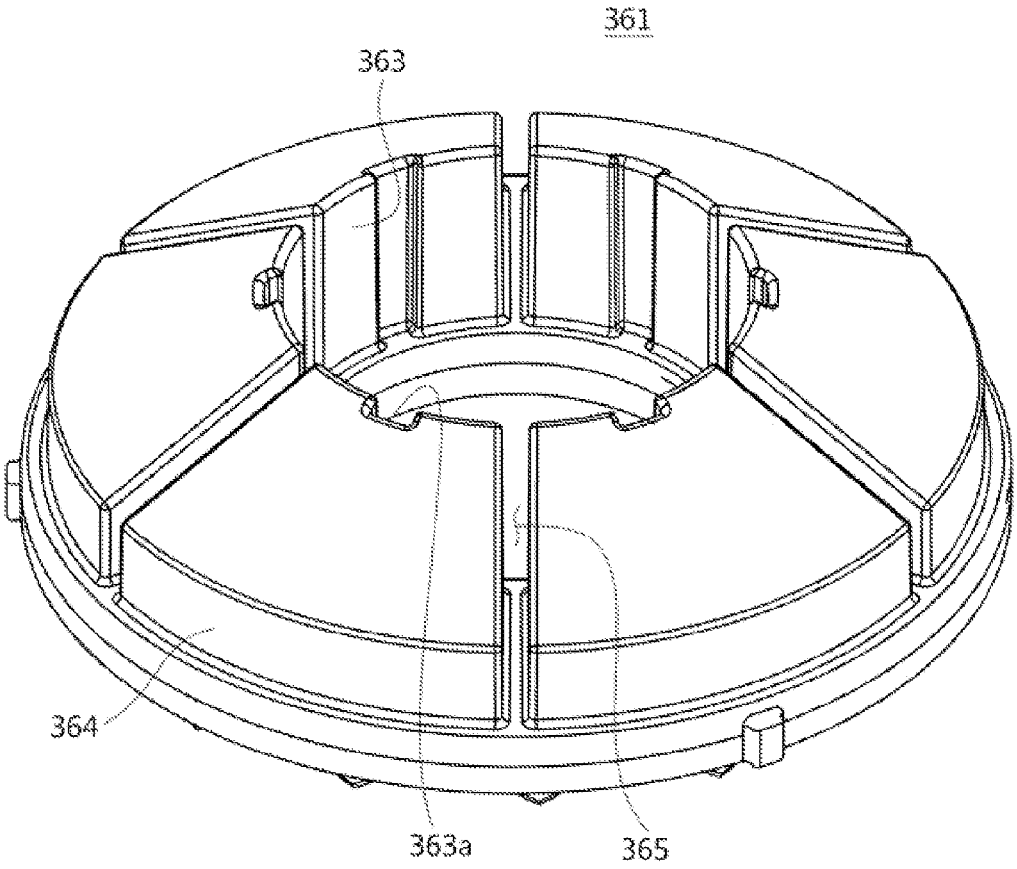
FIG. 19 is a schematic view illustrating a floater according to an embodiment of the disclosure.

FIG. 17 is a bottom view illustrating a pulsator according to an embodiment of the disclosure. FIG. 18 is an enlarged bottom perspective view illustrating the pulsator of FIG. 17. FIG. 19 is a schematic view illustrating a floater according to an embodiment of the disclosure.

The pulsator and the floater according to an embodiment of the disclosure will hereinafter be described with reference to FIGS. 17 and 18. For convenience of description, the same or similar structures as those described in the above-mentioned embodiment are denoted by the same reference numerals, and explanation thereof will be omitted herein.

The pulsator 340 may include the reinforcement rib 346 radially protruding from the bottom surface 345 to reinforce stiffness; and the inner rib 348 and the outer rib 349 formed in a circumferential direction to cross the reinforcement rib 346. A shaft coupling unit 341 may be arranged at the center portion of the pulsator 340. The floater accommodation space 350 may be formed among the reinforcement rib 346, the inner rib 346, and the outer rib 349.

The reinforcement rib 346 may be inserted into the guide groove 365 of the floater 361, so that the ascending and descending movements of the floater 361 can be guided and the rotational force can be applied to the floater 361. The inner rib 348 and the outer rib 349 may movably support the inner lateral surface 363 and the outer lateral surface 364 of the floater 361, respectively.

The pulsator 340 may further include an auxiliary guide rail 348*a* configured to guide the ascending and descending movement of the floater 361. The auxiliary guide rail 348*a* may protrude from the inner rib 348 to the floater accommodation space 350. However, the scope or spirit of the disclosure is not limited thereto, and the auxiliary guide rail 348*a* may protrude from the outer rib 349 or the reinforcement rib 346 to the floater accommodation space 350.

The auxiliary guide rail 348*a* may have any of various shapes capable of being extended in the vertical direction.

The floater 361 may include a guide groove 365 in which the reinforcement rib 346 of the pulsator 3340 is inserted; and a rail groove 363*a* in which the auxiliary guide rail 348*a* is inserted. As a result, because of the guide groove 365, the floater 361 can ascend or descend along the reinforcement rib 346, and can receive the rotational force from the reinforcement rib 346 of the pulsator 340. Because of the rail groove 363*a*, the floater 361 can ascend or descend along the auxiliary guide rail 348*a*.

Although the rail groove 363*a* is formed in the internal lateral surface 363 of the floater 361 for convenience of description, the scope or spirit of the disclosure is not limited thereto, and the rail groove 363*a* may be formed at the outer lateral surface 364 of the floater 361 or at the lateral surface 366 of the guide groove 365. By the auxiliary guide rail 348*a* and the rail groove 363*a*, the floater 361 may more stably ascend or descend.

Reference number 347 of FIG. 17 denotes an edge rib formed at the bottom flange portion of the pulsator 340.

Figure 20:
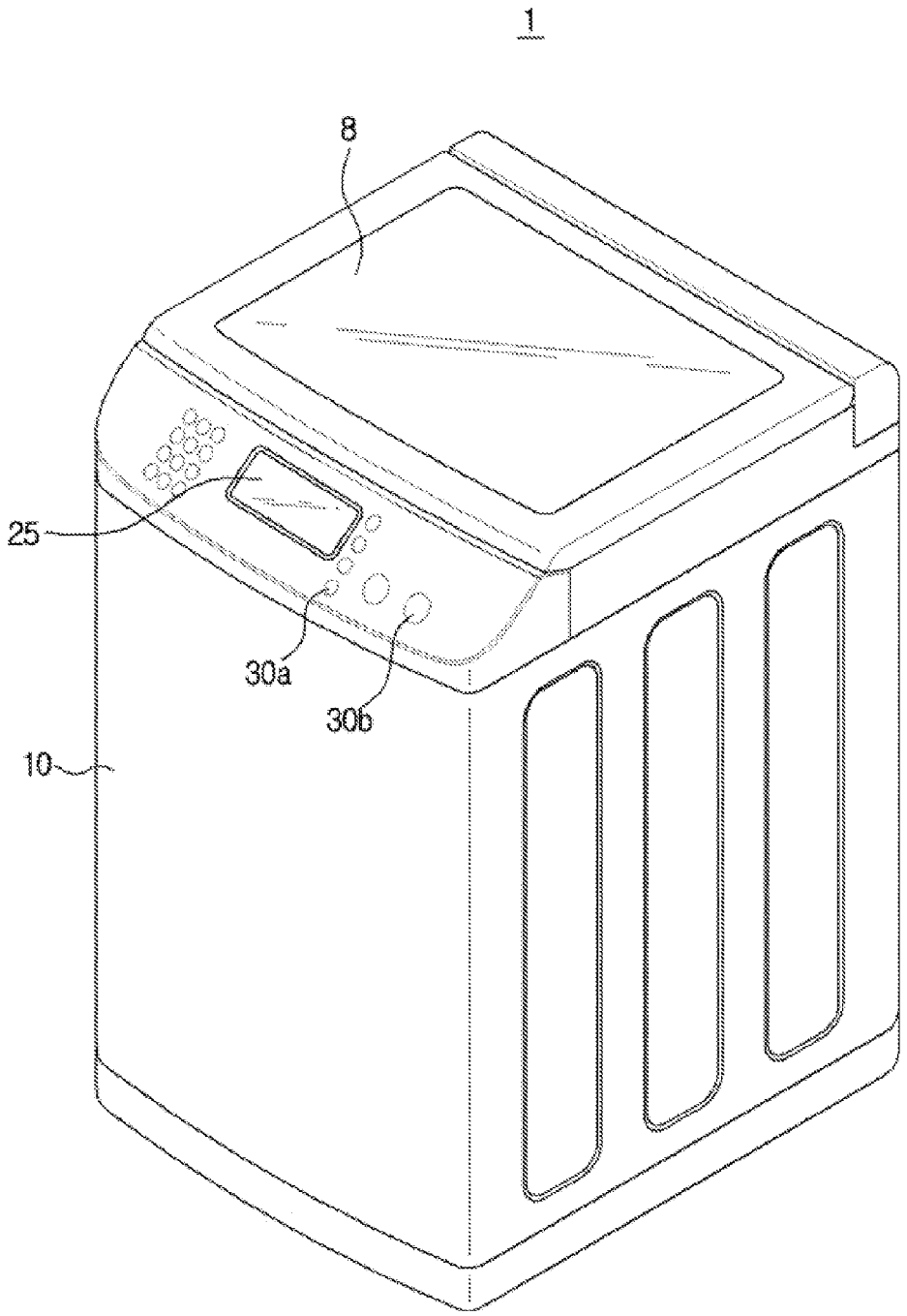
FIG. 20 is a perspective view illustrating the external appearance of the washing machine shown in FIG. 1.

FIG. 20 is a perspective view illustrating the external appearance of the washing machine shown in FIG. 1.

Referring to FIG. 20, the washing machine 1 may include an input unit 30 for receiving user commands which are associated with various operations and power on/off functions of the washing machine 1; and a display unit 25 for displaying operations of the washing machine 1.

In this embodiment, the input unit 30 is provided separately from the display unit 25, and the input unit 30 configured in a touch panel shape may be integrated with the display unit 25.

The input unit 30 may include a variety of buttons. The input unit 30 may include a power button 30*a* configured to power the washing machine 1 on or off. If the user presses the power button 30*a*, the washing machine 1 may be powered on. In this case, if the user re-presses the power button 30*a*, the washing machine 1 may be powered off.

The input unit 30 may include an operation button 30*b* for operating/stopping the washing machine 1. If the user presses the operation button 30*b*, the washing machine 1 may perform the washing process, the rinsing process, the dehydration process, etc.

In the washing process and the rinsing process, the water supply device 2 may provide the tub 11 with wash water. The driving power is generated by rotation of the motor 13, the driving power of the motor 13 is applied to the pulsator 40, so that the pulsator 40 can rotate. The water current is formed in the rotary tub 20 by rotation of the pulsator 40, so that laundry can be washed and rinsed.

During the dehydration process, the drain device 5 may discharge wash water stored in the tub 11 to the outside. The driving power may occur by rotation of the motor 13, and the driving power of the motor 13 may be applied to the rotary tub 20 and the pulsator 40. As the pulsator 40 and the rotary tub 20 are simultaneously rotated, wash water contained in the laundry may be dehydrated.

Therefore, if the user presses the operation button 30*b*, the water supply device 2, the motor 13, the drain device 5, etc. needed for respective processes may be driven or stopped.

Figure 21:
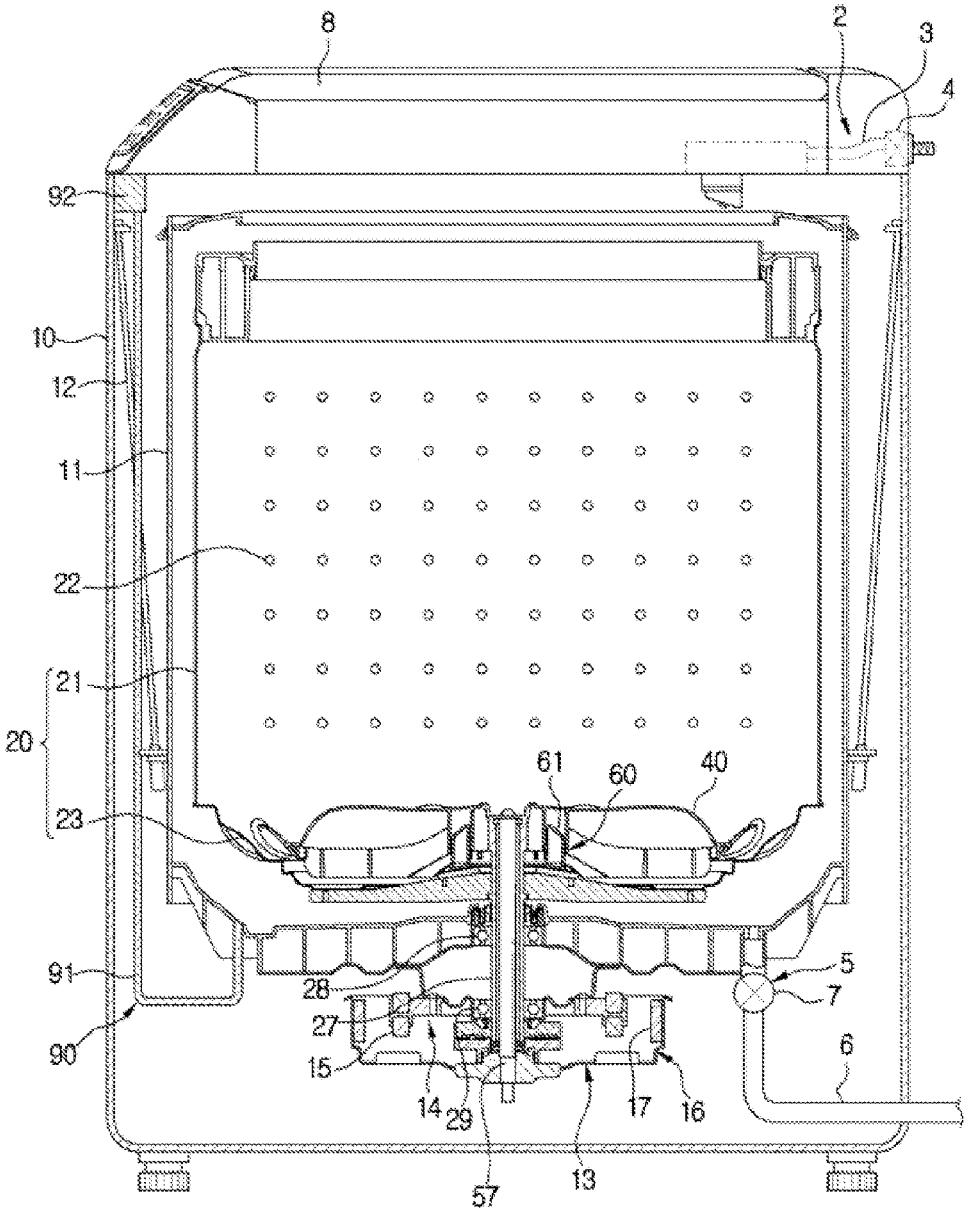
FIG. 21 is a schematic view illustrating an internal structure of a washing machine according to an embodiment of the disclosure.
Figure 22:
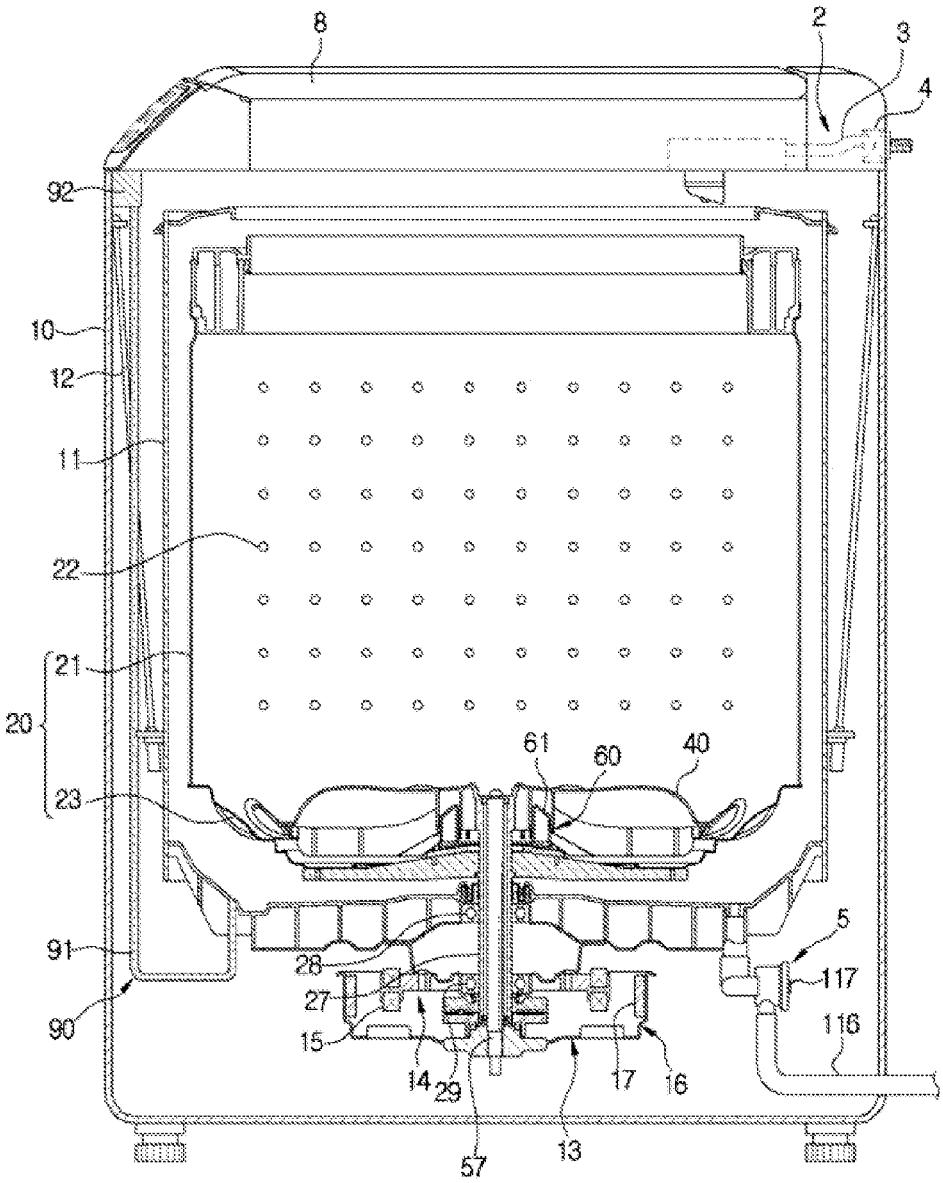
FIG. 22 is a schematic view illustrating an internal structure of a washing machine according to an embodiment of the disclosure.
Figure 23:
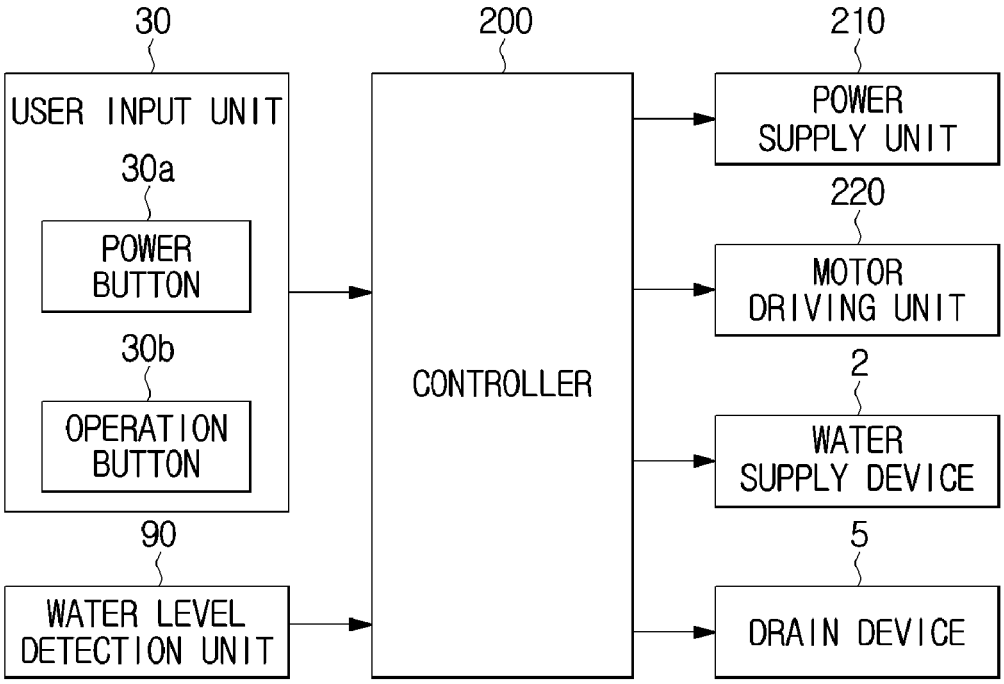
FIG. 23 is a block diagram illustrating a washing machine according to an embodiment of the disclosure.
Figure 24:
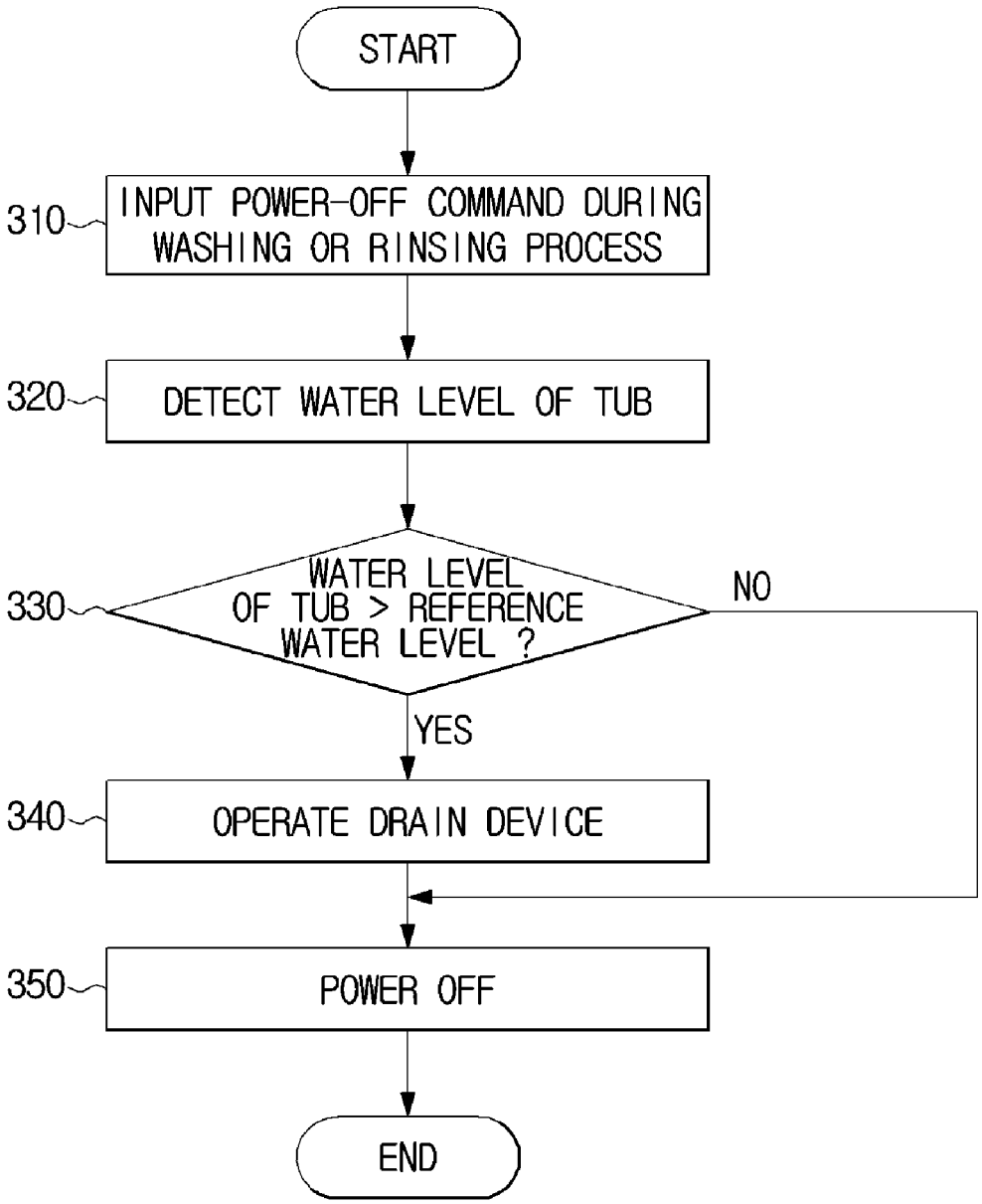
FIG. 24 is a flowchart illustrating a method for controlling a washing machine according to an embodiment of the disclosure.
Figure 25:
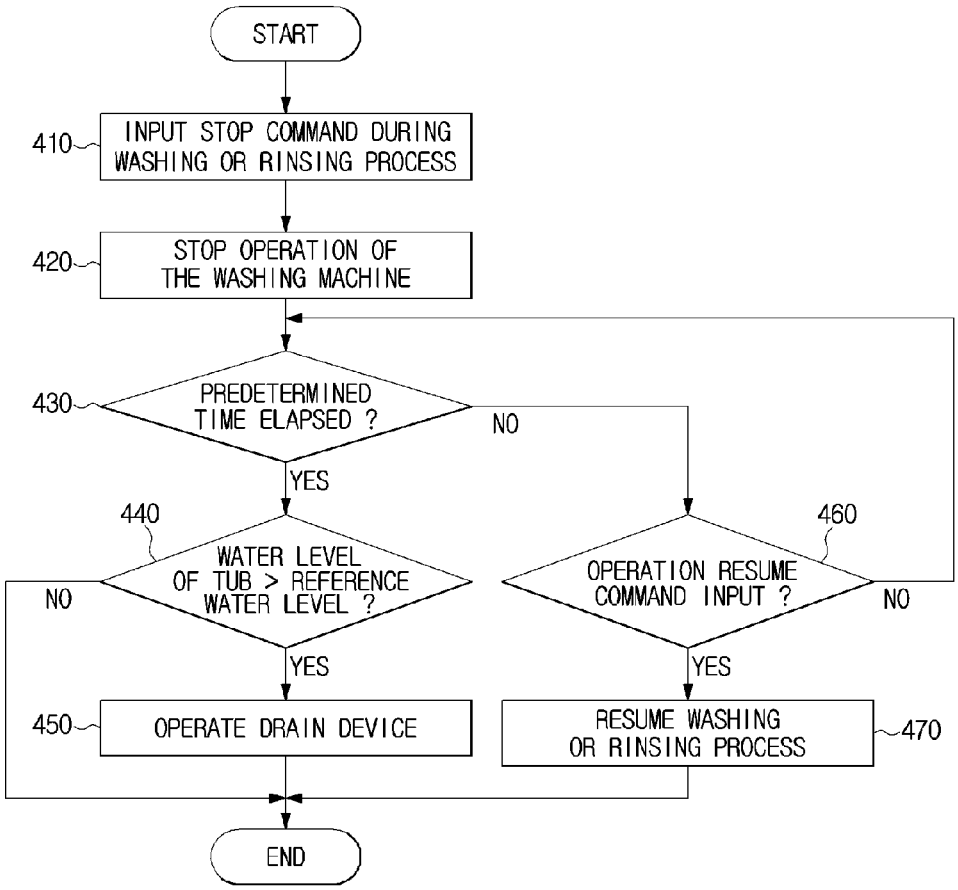
FIG. 25 is a flowchart illustrating a method for controlling a washing machine according to an embodiment of the disclosure.

FIG. 21 is a schematic view illustrating an internal structure of a washing machine according to an embodiment of the disclosure. FIG. 22 is a schematic view illustrating an internal structure of a washing machine according to an embodiment of the disclosure. FIG. 23 is a block diagram illustrating a washing machine according to an embodiment of the disclosure. FIG. 24 is a flowchart illustrating a method for controlling a washing machine according to an embodiment of the disclosure. FIG. 25 is a flowchart illustrating a method for controlling a washing machine according to an embodiment of the disclosure.

The washing machine may further include a water level detection unit 90 configured to detect a water level of the tub 11. The water level detection unit 90 may be formed in various shapes. For example, the water level detection unit 90 may include a water level detection pipe 91 extended from a lower part of the tub 11 to an upper part of the main body 10, and a pressure sensor 92 configured to detect inner pressure of the water level detection pipe 91.

If wash water is supplied to the tub 11, the wash water is also supplied to the water level detection pipe 91 coupled to the lower part of the tub 11, and the water level of the water level detection pipe 91 is gradually increased in proportion to the increasing water level of the wash water stored in the tub 11. If the water level of the water level detection pipe 91 increases, the air contained in the water level detection pipe 91 is compressed, so that the inner pressure of the water level detection unit 91 is increased.

The pressure sensor 91 may detect the inner pressure of the water level detection pipe 91.

The water level detection unit 90 may transmit an electric signal corresponding to pressure detected by the pressure sensor 92 to the controller 200. The controller 200 may determine the water level of the tub 110 upon receiving the inner pressure of the water level detection pipe 91 from the water level detection unit 90.

Although the drain device 5 of the washing machine is configured to have the drain pipe 6 and the drain valve 7 as described above, it should be noted that the drain device 5 may also be comprised of the drain pipe 116 and the drain pump 117. The drain pump 117 may include a housing (not shown) configured to accommodate water therein; an impeller (not shown) configured to pump water stored in the housing; and a drain motor (not shown) configured to drive the impeller. By means of the drain pump 117, the wash water can be mandatorily discharged toward a higher position than the tub 1.

The washing machine may include a power-supply unit 210 for receiving power from an external part and powering the washing machine on or off; and a motor driving unit 220 electrically connected to the power-supply unit 210 so that the motor 13 for rotating the pulsator 40 and the rotary tub 20 is powered on.

The washing machine may include a controller 200. The controller 200 may respectively receive a user command and water level information of the tub 11 from the user input unit 30 and the water level detection unit 90, and may control the power-supply unit 210, the motor driving unit 220, the water supply unit 2, and the drain device 5 on the basis of the received user command and water level information.

If the washing machine is exposed to an unexpected situation for a long period of time under the condition that the remaining wash water is present in the tub 11, the washing machine can prevent the floater 61 located in the tub 11 from being unexpectedly exposed to the wash water for a long period of time, so that mold is prevented from being generated.

As shown in FIG. 24, if a power-off command is input to the input unit 30 in operation 310, the water level detection unit 90 may detect the water level of the tub 11 in operation 320.

The controller 200 may compare the water level (of the tub 11) detected by the water level detection unit 90 with a predetermined reference water level of the tub 11, and may determine whether the water level of the tub 11 is higher than the reference water level in operation 330. In this case, the reference water level may be zero "0". That is, it may be determined whether there is remaining water in the tub 11.

If the water level of the tub 11 is higher than the reference water level, the controller 200 may operate the drain device 5 so that the wash water of the tub 11 may be discharged to the outside in operation 340. If the wash water is completely discharged from the tub 11, the controller 200 may power off the washing machine by controlling the power-supply unit 210 in operation 350. If the water level of the tub 11 is not higher than the reference water level, the controller 200 immediately controls the power-supply unit 210 so that the washing machine can be powered off.

By the above-mentioned constituent elements, when the user inputs a power-off command to the input unit 30, the washing machine is not immediately powered off, and the washing machine is powered off after wash water of the tub 11 has been discharged to the outside. Therefore, the embodiment of the disclosure can prevent the occurrence of mold in the floater 61 arranged in the tub 11 when the washing machine having the tub 11 in which remaining water is present is powered off, so that the washing machine can prevent operational reliability of the floater 61 from being deteriorated.

The above-mentioned control method may be applied only to the case in which the power-off command is input to the washing machine during the washing or rinsing process, because the tub 11 is filled with wash water during the washing or rinsing process and wash water is not supplied to the tub 11 during the dehydration process.

Meanwhile, as shown in FIG. 25, the washing machine may be controlled in a similar way to the above-mentioned control method even when the user inputs the stop command to the washing machine.

If the stop command is input to the input unit 30 in operation 410, the washing machine may stop a current operation in operation 420, and may count a time elapsed after the washing machine stops operation.

If the elapsed time reaches a predetermined reference time in operation 430, the controller 200 compares a water level detected by the water level detection unit 90 with a predetermined reference water level of the tub 11, so that it determines whether the water level of the tub 11 is higher than the reference water level in operation 440. In this case, the reference water level may be set to zero. That is, the controller 200 may determine the presence or absence of remaining water in the tub 11.

If the water level of the tub 11 is higher than the reference water level, the controller 200 drives the drain device 5 so that the wash water of the tub 11 can be discharged to the outside in operation 450. Furthermore, if the wash water is completely drained from the tub 11, the controller 200 may power off the washing machine under the control of the power-supply unit 210.

If the operation resume command is input to the input unit 30 in operation 460 before the elapsed time of operation 430 reaches a predetermined reference time, the controller 200 may resume the interrupted operation in operation 470.

By the above-mentioned configuration, even when the washing machine is unexpectedly left alone for a long period of time after the user stops the washing machine for a while, the washing machine discharges the wash water of the tub 11 to the outside, so that the floater 61 contained in the tub 11 is prevented from being exposed to the wash water for a long period of time and the operation reliability of the floater 61 is prevented from being deteriorated.

As is apparent from the above description, the clutch device for use in the washing machine according to the embodiments, configured to alternatively transmit the driving power of the motor only to the pulsator or to simultaneously transmit the driving power of the motor to the pulsator and the rotary tub, need not use the actuator, and can be operated using buoyancy of wash water, so that the number of constituent components and production costs of the washing machine are reduced and the number of fabrication processes can also be reduced.

The floater for use in the washing machine is provided to ascend or descend along a reinforcement rib configured to reinforce stiffness of the pulsator, so that it is not necessary for the pulsator to be additionally shaped and the pulsator has a simplified structure.

The space accommodating the floater therein is sealed by the floater when the floater ascends, air discharge holes are formed in the pulsator so that air is leaked from the floater accommodation space and thus the floater can be more stably operated.

The washing machine according to the disclosure can prevent the floater located in the tub from being unexpectedly exposed to the wash water for a long period of time, so that mold is prevented from occurring and reliability of the floater can be prevented from being deteriorated.

The above-described embodiments may be recorded in computer-readable media including program instructions to implement various operations embodied by a computer. The media may also include, alone or in combination with the program instructions, data files, data structures, and the like. The program instructions recorded on the media may be those specially designed and constructed for the purposes of embodiments, or they may be of the kind well-known and available to those having skill in the computer software arts. Examples of computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. The computer-readable media may also be a distributed network, so that the program instructions are stored and executed in a distributed fashion. The program instructions may be executed by one or more processors. The computer-readable media may also be embodied in at least one application specific integrated circuit (ASIC) or Field Programmable Gate Array (FPGA), which executes (processes like a processor) program instructions. Examples of program instructions include both machine code, such as produced by a compiler, and files containing higher level code that may be executed by the computer using an interpreter. The above-described devices may be configured to act as one or more software modules in order to perform the operations of the above-described embodiments, or vice versa.

Although a few embodiments of the disclosure have been shown and described, it would be appreciated by those skilled in the art that changes may be made in these embodiments without departing from the principles and spirit of the invention, the scope of which is defined in the claims and their equivalents.

What is claimed is:

1. A washing machine comprising:

a tub configured to accommodate wash water therein;

a rotary tub rotatably mounted in the tub;

a pulsator rotatably arranged in the rotary tub, configured to form a water current;

a motor configured to provide driving power to the pulsator; and a floater configured to ascend or descend in response to a water level of the wash water in such a manner that the pulsator and the rotary tub interact with each other or the interaction therebetween is released, wherein the pulsator includes an inner rib and an outer rib, which protrude from a bottom surface of the pulsator, and are configured to respectively support an inner lateral surface and an outer lateral surface of the floater, and a reinforcement rib configured to cross the inner rib and the outer rib, and protruding from a bottom surface of the pulsator to reinforce stiffness, and the floater is connected to the reinforcement rib in a manner that the floater ascends or descends along the reinforcement rib.

2. The washing machine according to claim 1, wherein the floater includes a guide groove in which the reinforcement rib is inserted so that the floater ascends or descends along the reinforcement rib.

3. The washing machine according to claim 1, wherein the reinforcement rib is configured in a radial form.

4. The washing machine according to claim 1, wherein the reinforcement rib is extended from a shaft coupling unit of the pulsator to a flange portion of the pulsator.

5. The washing machine according to claim 1, wherein the pulsator includes:

an edge rib protruding from a bottom surface of the pulsator, configured to be formed along a circumferential direction at a flange portion of the pulsator, wherein the reinforcement rib is supported by closely contacting the edge rib.

6. The washing machine according to claim 1, wherein the pulsator includes a floater accommodation space formed among the reinforcement rib, the inner rib, and the outer rib to accommodate the floater therein.

7. The washing machine according to claim 6, wherein the floater accommodation space is sealed to prevent permeation of foreign materials when the floater ascends.

8. The washing machine according to claim 7, wherein the floater includes an inner flange portion and an outer flange portion which are configured to closely contact the inner rib and the outer rib, respectively, to seal the floater accommodation space when the floater ascends.

9. The washing machine according to claim 6, wherein the pulsator includes air discharge holes through which air of the floater accommodation space is discharged outside when the floater ascends.

10. The washing machine according to claim 1, wherein the floater is line-contacted with the reinforcement rib.

11. The washing machine according to claim 10, wherein the floater includes a convex portion configured to protrude toward the reinforcement rib so that the floater is line-contacted with the reinforcement rib.

12. The washing machine according to claim 1, wherein the pulsator includes:

an auxiliary guide rail formed in at least one of the reinforcement rib, the inner rib, and the outer rib to guide the ascending and descending movement of the floater.

13. The washing machine according to claim 12, wherein the floater includes:

a rail groove in which the auxiliary guide rail is inserted in such a manner that the floater ascends or descends along the auxiliary guide rail.

14. The washing machine according to claim 1, further comprising:

a coupler which is separated from the floater when the floater ascends, and is connected to the floater when the floater descends so that the coupler receives rotational force.

15. The washing machine according to claim 14, further comprising:

a flange shaft including a drive flange coupled to the rotary tub and a dehydration shaft rotatably supporting the drive flange, wherein the coupler is fixed to the drive flange.

16. The washing machine according to claim 14, wherein:

the floater includes a floater interaction unit formed at a bottom surface of the floater, configured to be coupled to the coupler when the floater descends so that the rotational force is applied to the coupler, and the coupler includes a coupler interaction unit which is connected to the floater interaction unit when the floater descends to receive the rotational force.

17. The washing machine according to claim 16, wherein the floater interaction unit includes interaction teeth protruding from the bottom surface of the floater.

18. The washing machine according to claim 17, wherein the interaction teeth includes tilted surfaces respectively formed at a left region and a right region on the basis of a center line arranged in a radial direction.

19. The washing machine according to claim 17, wherein the coupler interaction unit includes an interaction slot in which the interaction teeth are inserted.

20. The washing machine according to claim 19, wherein the coupler includes a guide surface obliquely formed between the neighboring interaction slots that are configured to direct the interaction teeth toward the interaction slot when the floater descends.

21. The washing machine according to claim 19, wherein the coupler includes:

a water-drain passage configured to drain wash water from the interaction slot to the outside.

22. The washing machine according to claim 17, wherein the coupler interaction unit includes correspondence teeth configured to be meshed with the interaction teeth when the floater descends.

23. A washing machine comprising:

a tub configured to accommodate wash water therein;

a rotary tub rotatably mounted in the tub;

a pulsator rotatably arranged in the rotary tub, configured to form a water current, and including a reinforcement rib protruding from a bottom surface of the pulsator to reinforce stiffness;

a motor configured to provide driving power to the pulsator; and a floater coupled to a bottom surface of the pulsator, configured to ascend or descend in response to a water level of the wash water in such a manner that the pulsator and the rotary tub interact with each other or the interaction therebetween is released, wherein the pulsator includes an inner rib and an outer rib, which protrude from a bottom surface of the pulsator, and are configured to respectively support an inner lateral surface and an outer lateral surface of the floater, the reinforcement rib configured to cross the inner rib and the outer rib, and a floater accommodation space formed at the bottom surface of the pulsator to accommodate the floater therein, wherein the floater accommodation space is sealed by the floater when the floater ascends, and wherein the floater is connected to the reinforcement rib in a manner that the floater ascends or descends along the reinforcement rib.

24. The washing machine according to claim 23, wherein the pulsator includes:

the reinforcement rib formed in a radial shape; and the inner rib and the outer rib are formed along a circumferential direction to respectively support an inner lateral surface and an outer lateral surface of the floater, wherein the floater accommodation space is formed by the reinforcement rib, the inner rib, and the outer rib.

25. The washing machine according to claim 24, wherein the floater includes an inner flange portion and an outer flange portion which are configured to closely contact the inner rib and the outer rib, respectively, to seal the floater accommodation space when the floater ascends.

26. The washing machine according to claim 23, wherein the pulsator includes air discharge holes through which air of the floater accommodation space is leaked outside when the floater ascends.

27. A washing machine comprising:

a tub configured to accommodate wash water therein;

a rotary tub rotatably mounted in the tub;

a pulsator rotatably arranged in the rotary tub, configured to form a water current, and including a reinforcement rib protruding from a bottom surface of the pulsator to reinforce stiffness;

a motor configured to provide driving power to the pulsator;

a drain device configured to discharge wash water from the tub;

a water level detection unit configured to detect a water level of the tub;

an input unit configured to receive a user command;

a floater mounted in the tub, configured to ascend or descend in response to the water level of the tub to transmit the driving power of the motor to the pulsator and the rotary tub; and a controller, if a power-off command for powering off the washing machine or a stop command for stopping the washing machine is input to the input unit, configured to operate the drain device in response to the tub water-level detected by the water level detection unit, wherein the pulsator includes an inner rib and an outer rib, which protrude from a bottom surface of the pulsator, and are configured to respectively support an inner lateral surface and an outer lateral surface of the floater, the reinforcement rib configured to cross the inner rib and the outer rib, wherein the floater is configured to ascend or descend in response to a water level of the wash water in such a manner that the pulsator and the rotary tub interact with each other or the interaction therebetween is released, and wherein the floater is connected to the reinforcement rib in a manner that the floater ascends or descends along the reinforcement rib.

28. The washing machine according to claim 27, wherein:

if the power-off command of the washing machine is input to the input unit, the controller determines whether the tub water-level is higher than a predetermined reference water level, and if the tub water-level is higher than the predetermined reference water level, the controller drains the wash water from the tub by operating the drain device and then powers off the washing machine.

29. The washing machine according to claim 27, wherein:

if the stop command of the washing machine is input to the input unit, the controller counts a time elapsed after reception of the stop command, if a predetermined time elapses, the controller determines whether the tub water-level is higher than a predetermined reference water level, and if the tub water-level is higher than the predetermined reference water level, the controller drains wash water from the tub by operating the drain device.

30. A method for controlling a washing machine including tub configured to accommodate wash water therein, a rotary tub rotatably mounted in the tub, a pulsator rotatably arranged in the rotary tub, configured to form a water current, a motor configured to provide driving power to the pulsator, and a floater configured to ascend or descend in response to a water level of the wash water in such a manner that the pulsator and the rotary tub interact with each other or the interaction therebetween is released, wherein the pulsator includes an inner rib and an outer rib, which protrude from a bottom surface of the pulsator, and are configured to respectively support an inner lateral surface and an outer lateral surface of the floater, and a reinforcement rib configured to cross the inner rib and the outer rib, and protruding from a bottom surface of the pulsator to reinforce stiffness, and the floater is connected to the reinforcement rib in a manner that the floater ascends or descends along the reinforcement rib, the method comprising:

receiving a power-off command or a stop command from a user;

detecting the water level of the tub;

determining whether the water level of the tub is higher than a predetermined reference water level; and if the water level of the tub is higher than the predetermined reference water level, draining wash water from the tub to the outside.

31. The method according to claim 30, further comprising:

after the wash water of the water is completely drained to the outside, powering the washing machine off.

32. The method according to claim 30, further comprising:

counting a time elapsed after receiving the stop command from the user; and detecting a water level of the tub after lapse of a predetermined time.

* * * * *